US009330512B2

(12) United States Patent
Ogata

(10) Patent No.: US 9,330,512 B2
(45) Date of Patent: May 3, 2016

(54) METHOD FOR MANAGING INFORMATION

(71) Applicant: Panasonic Intellectual Property Management Co., Ltd., Osaka (JP)

(72) Inventor: Shinsuke Ogata, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/663,956

(22) Filed: Mar. 20, 2015

(65) Prior Publication Data

US 2015/0287253 A1 Oct. 8, 2015

Related U.S. Application Data

(60) Provisional application No. 61/974,511, filed on Apr. 3, 2014.

(30) Foreign Application Priority Data

Oct. 10, 2014 (JP) ..... 2014-209450

(51) Int. Cl.
*G07C 9/00* (2006.01)
*G07F 17/10* (2006.01)
*G07F 17/12* (2006.01)

(52) U.S. Cl.
CPC ..... *G07C 9/00111* (2013.01); *G07F 17/10* (2013.01); *G07F 17/12* (2013.01)

(58) Field of Classification Search
CPC .... G07C 9/00111; G05B 15/02; G07F 17/10; G07F 17/12; E05B 17/22
See application file for complete search history.

(56) References Cited

U.S. PATENT DOCUMENTS

2005/0190037 A1 9/2005 Shitan et al.
2015/0235215 A1 * 8/2015 Kumar ..... G06Q 20/4014 705/44

FOREIGN PATENT DOCUMENTS

JP 2004-156377 6/2004

* cited by examiner

*Primary Examiner* — Curtis Odom
(74) *Attorney, Agent, or Firm* — Greenblum & Bernstein, P.L.C.

(57) ABSTRACT

A method for managing information obtains, through a first communication circuit, a locker identifier and a user identifier from a locker into which a user card has been inserted, obtaining, through a second communication circuit, a machine identifier and a key identifier from a machine that has read the key identifier, and outputting, using a first database that associates the locker identifier and the key identifier with each other and the obtained locker identifier and user identifier, the user identifier corresponding to the key identifier to the machine to set the user identifier to the machine.

10 Claims, 31 Drawing Sheets

FIG. 14

810

CUSTOMER PERSONAL INFORMATION DATABASE

| 811 USER ID | 812 NAME | 813 AGE | 814 GENDER |
|---|---|---|---|
| 219_134_127_211_113_0_39_1 | Ogata | 34 | M |
| 219_134_127_211_113_0_39_2 | XXXX | 30 | F |
| 219_134_127_211_113_0_39_3 | YYYY | 33 | M |

FIG. 15

820

TRAINING RECORD DATABASE

| 821 USER ID | 822 LAST TRAINING DATE | 823 AVERAGE TRAINING TIME OF MONTH | 824 AVERAGE TRAINING PULSE OF MONTH |
|---|---|---|---|
| 219_134_127_211_113_0_39_1 | 7/5/2014 | 30 min. | 120 |
| 219_134_127_211_113_0_39_2 | 7/7/2014 | 60 min. | 115 |
| 219_134_127_211_113_0_39_3 | 6/12/2014 | 45 min. | 100 |

910

KEY DATABASE 911 912

| KEY ID | LOCKER ID |
|---|---|
| 219_134_127_211_113_0_39_1 | 132.182.177.90 |
| 219_134_127_211_113_0_39_2 | 132.182.177.10 |
| 219_134_127_211_113_0_39_3 | 132.182.177.20 |

FIG. 18

920

LOCKER BODY DATABASE 921 922

| LOCKER ID | USER ID |
|---|---|
| 132.182.177.90 | 219_134_127_211_113_0_39_1 |
| 132.182.177.10 | null |
| 132.182.177.20 | 219_134_127_211_113_0_39_2 |

FIG. 19

930

MACHINE DATABASE 931 932

| MACHINE ID | USER ID |
|---|---|
| 132.182.177.120 | 219_134_127_211_113_0_39_1 |
| 132.182.177.130 | null |
| 132.182.177.140 | 219_134_127_211_113_0_39_2<br>219_134_127_211_113_0_39_3 |

METHOD FOR MANAGING INFORMATION

BACKGROUND

1. Technical Field

The present disclosure relates to a method for managing information used by an information management system connected to lockers and training machines through a network.

2. Description of the Related Art

Currently, a technique that manages association between lockers in a sport club and users of the lockers has been disclosed (Japanese Patent No. 4290410).

SUMMARY

However, further improvements are desired for Japanese Patent No. 4290410.

In one general aspect, the techniques disclosed here feature a method for managing information obtains, through a first communication circuit, a locker identifier and a user identifier from a locker into which a user card has been inserted, obtaining, through a second communication circuit, a machine identifier and a key identifier from a machine that has read the key identifier, and outputting, using a first database that associates the locker identifier and the key identifier with each other and the obtained locker identifier and user identifier, the user identifier corresponding to the key identifier to the machine to set the user identifier to the machine.

According to the above aspect, further improvements can be achieved.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 14 is a table illustrating an example of the content of a customer personal information database according to the embodiment;

FIG. 15 is a table illustrating an example of the content of a training record database according to the embodiment;

FIG. 18 is a table illustrating an example of the content of a locker body database according to the embodiment;

FIG. 19 is a table illustrating an example of the content of a machine database according to the embodiment;

DETAILED DESCRIPTION

Figure 1:
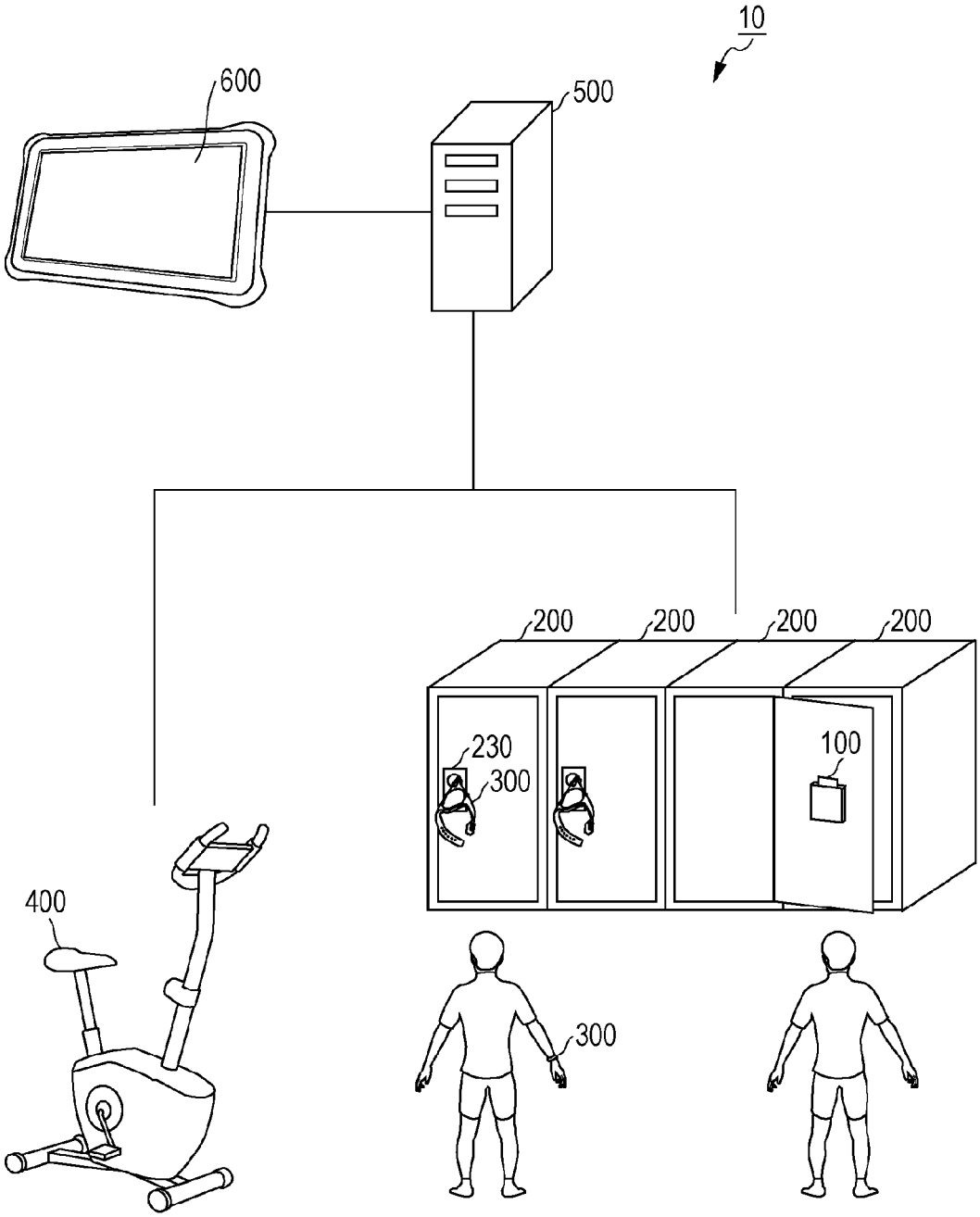
FIG. 1 is a diagram illustrating the overall configuration of an information management system according to an embodiment.

Underlying Knowledge Forming Basis of the Present Disclosure

The present inventors have found that the following problems arise in the technique disclosed in Japanese Patent No. 4290410.

First, prior to use of a locker, for example, a person at a front desk of a sport gym associates mobile identification information stored in a mobile key device, which is a locker key, and user identification information regarding a user of the locker with each other and stores the mobile identification information and the user identification information in a management computer (step 1). That is, the person at the front desk associates the mobile identification information stored in the locker key and the user identification information regarding the user of the locker with each other.

Next, the user carries the mobile key device given at the front desk and enters a locker room. The user uses an arbitrary locker that is not being used by anyone. If the user locks the locker using the mobile key device, the mobile identification information regarding the mobile key device is stored in the locker, and locker identification information regarding the locker is stored in the mobile key device (step 2).

Next, the user brings the mobile key device closer to a reading device connected to the management computer to make the reading device read the mobile identification information and the locker identification information stored in the mobile key device (step 3).

The reading device transmits the read mobile identification information and locker identification information to the management computer to store the mobile identification information and the locker identification information in the management computer (step 4). That is, the user needs to make the reading device read the mobile identification information and the locker identification information stored in the locker key.

By performing the above steps, the sport gym can identify which user is using which locker, that is, association between the user identification information and the locker identification information.

In the technique disclosed in Japanese Patent No. 4290410, however, processes performed by persons, that is, step 1 performed by the person at the front desk and step 4 performed by the user, are necessary. Therefore, there is a problem in that the work efficiency of the person at the front desk decreases, thereby slowing a check-in process for the user. Furthermore, the user needs to perform a troublesome operation, which is problematic.

On the basis of the above examination, the present inventors take the following improvement measures in order to solve the above problems.

A method for managing information according to an aspect of the present disclosure is a method for managing information used by an information management system connected, through a network and a machine. The method includes obtaining, through a first communication circuit included in the locker, a user identifier and a locker identifier from the locker into which the user card storing a user identifier indicating a user is inserted, the locker including i) a locking mechanism in which a key storing a key identifier becomes removable when the user card is inserted and ii) a first memory storing the locker identifier, obtaining, through a second communication circuit included in the machine, the key identifier and a machine identifier from the machine that has read the key identifier, the machine including i) a reader that reads the key identifier from the key and ii) a second memory storing the machine identifier, and outputting, using a first database that associates the locker identifier and the key identifier with each other and using the obtained locker identifier and the obtained user identifier, the user identifier corresponding to the key identifier to the machine to set the user identifier to the machine.

According to this aspect, even if the user card storing the user identifier indicating the user is inserted into the locker and therefore not available and the user carries the key storing the key identifier, not the user identifier, and uses the training machine, the user identifier and the key identifier are automatically associated with each other through the locker identifier indicating the locker without a process performed by the person at the front desk or the user. Therefore, the user can set the user identifier to the training machine just by making the training machine read the key identifier.

In addition, the information management system obtains the machine identifier and the key identifier from the training machine and sets, using the first database that manages the locker identifier and the key identifier while associating the locker identifier and the key identifier with each other and the obtained locker identifier and user identifier, the user identifier corresponding to the key identifier to the training machine. Therefore, for example, the sport gym can automatically identify the association between the user and the training machine used by the user.

In addition, for example, the locker includes the first communication circuit, and the information management system obtains the locker identifier and the user identifier from the locker. Therefore, the sport gym can automatically identify the association between the user identifier and the locker identifier without a process performed by the person at the front desk or the user.

In the above aspect, the machine may include a display. The information management system may output, using a second database that manages history information indicating how the user indicated by the user identifier has used the machine, the history information corresponding to the user identifier to the machine to display the history information on a display of the machine.

According to this aspect, even if the user card storing the user identifier indicating the user is inserted into the locker and therefore not available, the user can obtain the user's history information indicating use of the training machine just by making the training machine read the key identifier of the key that the user carries, without performing a troublesome process.

In the above aspect, the machine may further include a memory storing a training program, a display that displays an image after the training program is activated, and a controller that controls the machine on the basis of the training program. The method may further include setting the user identifier to the machine to enable the user corresponding to the user identifier to use the training program on the machine.

According to this aspect, the user can begin the training program available with the training machine just by making the training machine read the key identifier of the key, not the user identifier.

In the above aspect, the machine identifier stored in the second memory of the machine may be an Internet Protocol address. The method may further include outputting the user identifier corresponding to the key identifier to the machine corresponding to the Internet Protocol address.

In the above aspect, the locker identifier stored in the first memory of the locker may be an Internet Protocol address corresponding to the locker. The method may further include obtaining the Internet Protocol address corresponding to the locker as the locker identifier.

In the above aspect, IDm used in near field communication may be used as the key identifier.

According to this aspect, the user can set the user identifier to the training machine just by bringing the key of the locker closer to the training machine.

In the above aspect, IDm used in near field communication may be used as the user identifier.

According to this aspect, the user can transmit the user identifier to the information management system from the locker just by inserting the user card into the locker.

In the above aspect, the method may further include obtaining, through the first communication circuit, the locker identifier and the user identifier from the locker into which the user card is inserted, when the user card is inserted into the locker.

In the above aspect, the reader may be a detector that reads the key identifier from the key if the key enters a certain range around the machine. The method may further include obtaining, through the second communication circuit, the machine identifier and the key identifier from the machine that has read the key identifier, when the reader detects the key.

According to this aspect, the user can set the user identifier to the training machine just by bringing the key of the locker closer to the training machine.

In the above aspect, for example, the key may include a key portion and a belt portion. The belt portion may include a holder that holds the key identifier and a communicator that transmits the key identifier.

According to this aspect, even if the key holds the key identifier and has a function of transmitting the key identifier, the configuration of the key is simple. Accordingly, the key can be light, and, for example, even if the user wears the key around his/her wrist and uses the training machine, it is possible to prevent the key from disturbing the user during exercise using the training machine.

The method for managing information according to the aspect of the present disclosure will be specifically described with reference to the accompanying drawings.

An embodiment that will be described hereinafter is a specific example of the present disclosure. Values, shapes, materials, components, positions at which the components are arranged, connection modes of the components, steps, order of the steps, and the like are examples, and not intended to limit the present disclosure. Among the components described in the following embodiment, those not described in the independent claim, which defines a broadest concept, will be described as arbitrary components.

Embodiment

1. Overall Configuration

Figure 2:
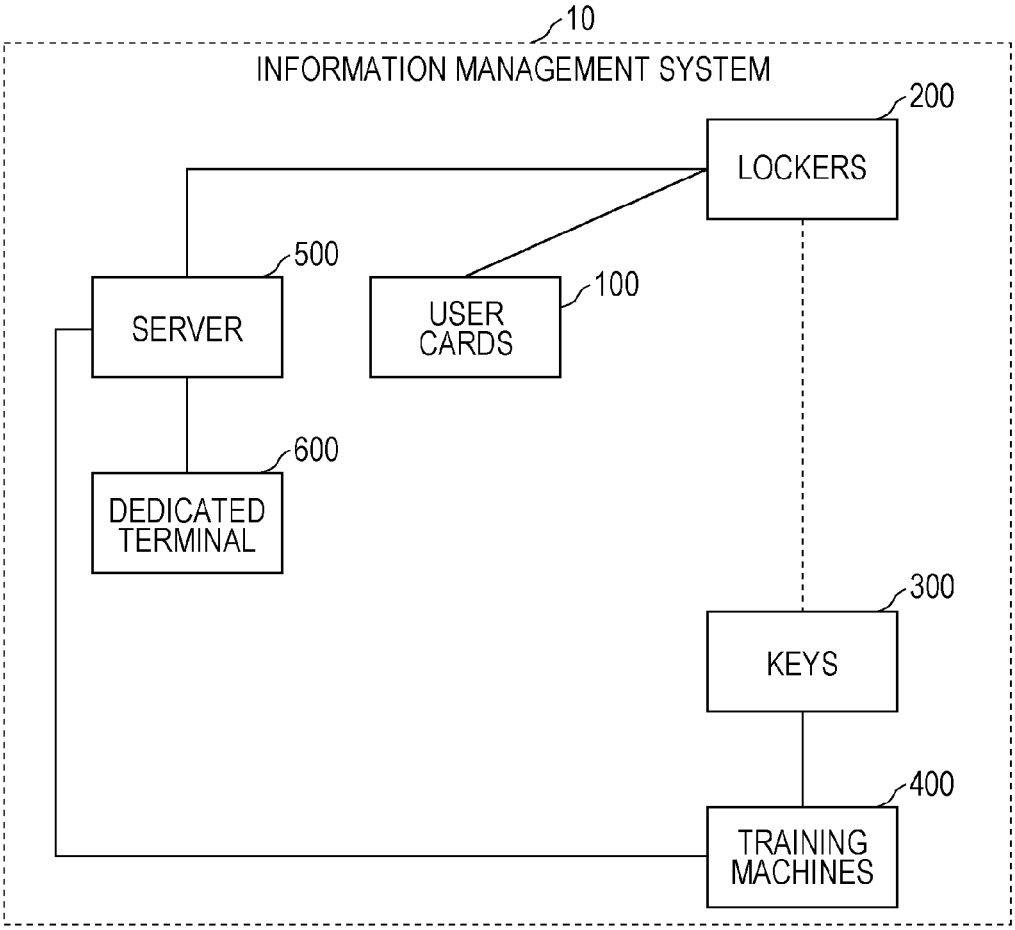
FIG. 2 is a block diagram illustrating the configuration of the information management system according to the embodiment.

FIG. 1 is a diagram illustrating the overall configuration of an information management system according to the embodiment. FIG. 2 is a block diagram illustrating the configuration of the information management system according to the embodiment. Components of an information management system 10 will be described hereinafter with reference to FIGS. 1 and 2.

As illustrated in FIGS. 1 and 2, the information management system 10 according to the embodiment includes user cards 100, lockers 200, keys 300, training machines 400, a server 500, and a dedicated terminal 600.

Each user card 100 is a user's membership card and stores a user identifier (ID). Each user card 100 is realized by a medium such as a near field communication (NFC) tag or an NFC card.

Each locker 200 reads the user ID from a user card 100, associates a locker ID and the user ID with each other, and transmits the locker ID and the user ID.

Each key 300 stores a key ID, which is associated with a locker ID in advance. More specifically, each key 300 includes a medium such as an NFC tag and stores the key ID using the medium. A key 300 is provided for each of a plurality of boxes included in the lockers 200 and capable of locking and unlocking the corresponding box.

The training machines 400 are training machines typified by stationary bicycles and treadmills. Each training machine 400 reads the key ID from a key 300 and transmits the key ID.

The server 500 receives a locker ID and a user ID from each locker 200. The server 500 also receives a key ID from each training machine 400. The server 500 detects a locker ID corresponding to the received key ID. The server 500 also detects a user ID corresponding to the detected locker ID. The server 500 transmits the detected user ID to the training machine 400.

The dedicated terminal 600 is a terminal for associating a key ID and a locker ID with each other.

The user ID is a value uniquely assigned to each of a plurality of users. The key ID is a value uniquely assigned to each of the plurality of keys 300. The locker ID is a value uniquely assigned to each of the plurality of boxes included in the lockers 200. More specifically, the locker ID may be a fixed value such as an Internet Protocol (IP) address.

Next, each component will be described in detail.

First, the configuration of the lockers 200 will be described.

Figure 3:
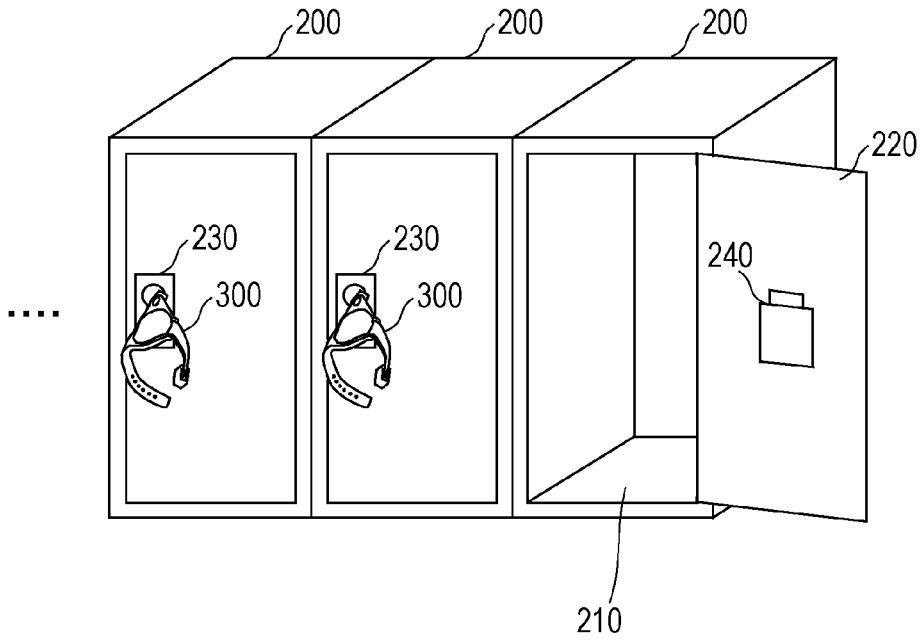
FIG. 3 is a diagram illustrating the appearance of lockers according to the embodiment.
Figure 4:
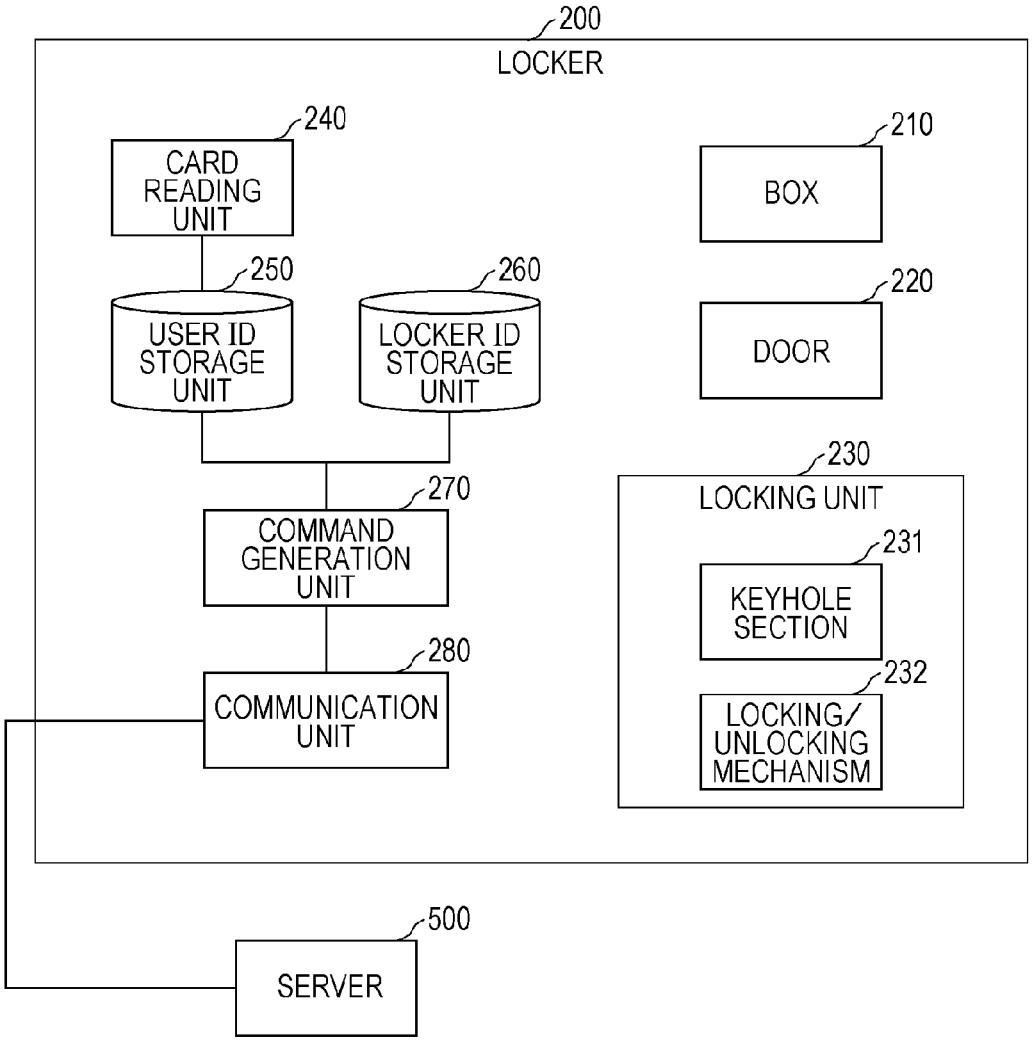
FIG. 4 is a block diagram illustrating an example of the functional configuration of a locker according to the embodiment.

FIG. 3 is a diagram illustrating the appearance of the lockers 200 according to the embodiment. FIG. 4 is a block diagram illustrating an example of the functional configuration of each locker 200 according to the embodiment.

Each of the plurality of lockers 200 includes a box 210 having an opening, a door 220, a locking unit 230, a card reading unit 240, a user ID storage unit 250, a locker ID storage unit 260, a command generation unit 270, and a communication unit 280.

The box 210 is a structure for storing a user's belongings such as clothes and valuables. Each box 210 may be configured as an individual box, or a single box may be divided into a plurality of boxes 210 using dividers.

The door 220 can open and close the opening of the corresponding box 210.

The locking unit 230 can lock the box 210 when the door 220 of the box 210 is closed. The locking unit 230 includes a keyhole section 231 and a locking/unlocking mechanism 232. The keyhole section 231 is a hole into which the key 300 is inserted in order to lock or unlock the locking/unlocking mechanism 232. The locking/unlocking mechanism 232 switches between a locked state and an unlocked state when operated by a user using the key 300 inserted into the keyhole section 231 (more specifically, when the key 300 is turned left or right). When the locker 200 is not being used by a user, the key 300 remains inserted into the keyhole section 231 of the locking unit 230. The locking unit 230 is a locking mechanism in which the key 300 inserted into the keyhole section 231 can be removed when a user card is inserted into a slit provided in the card reading unit 240.

The card reading unit 240 is a device for reading the user ID stored in the user card 100. More specifically, the card reading unit 240 is realized by a reading device such as an NFC reader.

The card reading unit 240 includes a slit into which the user card 100 is inserted, and can read the user ID from the user card 100 inserted into the slit.

The user ID storage unit 250 is a storage device that stores a user ID read by the card reading unit 240. More specifically, the user ID storage unit 250 is realized by a storage device such as a nonvolatile memory or a hard disk.

The locker ID storage unit 260 is a storage device that stores a locker ID. That is, the locker ID storage unit 260 functions as a first memory. More specifically, the locker ID storage unit 260 is realized by a storage device such as a nonvolatile memory or a hard disk.

The user ID storage unit 250 and the locker ID storage unit 260 may be realized by the same storage device. In this case, information regarding a user ID and a locker ID is stored such that the user ID and the locker ID can be distinguished from each other.

The command generation unit 270 generates a command using the user ID stored in the user ID storage unit 250 and the locker ID stored in the locker ID storage unit 260 and transmits the command to the communication unit 280.

The communication unit 280 transmits the user ID stored in the user ID storage unit 250 and the locker ID stored in the locker ID storage unit 260 to the server 500. That is, the communication unit 280 is a first communication circuit that outputs a locker ID and a user ID.

The configuration of the lockers 200 has been described.

Next, the configuration of the key 300 will be described.

Figure 5:
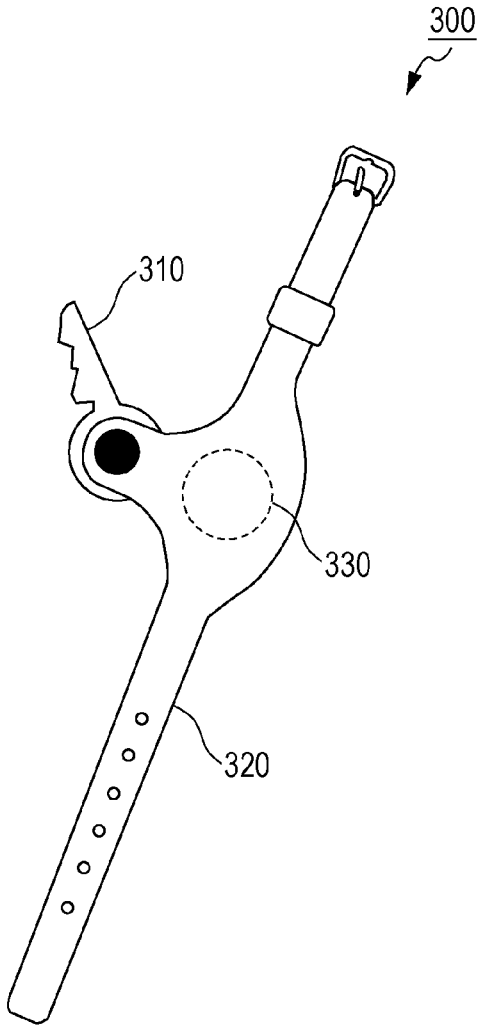
FIG. 5 is a diagram illustrating the appearance of a key according to the embodiment.
Figure 6:
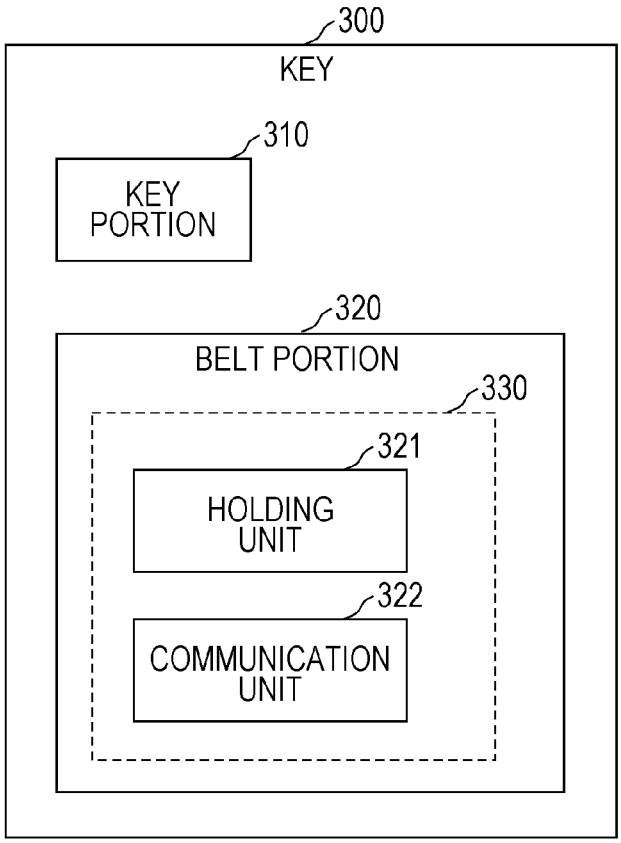
FIG. 6 is a block diagram illustrating the functional configuration of the key according to the embodiment.

FIG. 5 is a diagram illustrating the appearance of the key 300 according to the embodiment. FIG. 6 is a block diagram illustrating the functional configuration of the key 300 according to the embodiment.

The key 300 includes a key portion 310 and a belt portion 320. There are a plurality of keys 300 corresponding to the plurality of lockers 200. The key portion 310 is capable of locking and unlocking the locking unit 230 provided for the door 220 of the corresponding locker 200. More specifically, the key portion 310 is a metal plate member provided with cuts (teeth) for unlocking the corresponding locking unit 230. The belt portion 320 is, more specifically, a member composed of a resin, a cloth, or the like to be worn by the user (for example, around the user's wrist, ankle, or the like). In addition, in the key 300, a medium 330 for communicating with the training machines 400, such as an NFC tag, is provided in the belt portion 320. As illustrated in FIG. 6, in functional terms, the medium 330 includes a holding unit 321 and a communication unit 322. The holding unit 321 stores a key ID. The communication unit 322 transmits the key ID stored in the holding unit 321.

The configuration of the key 300 has been described.

Next, the configuration of the server 500 will be described.

Figure 7:
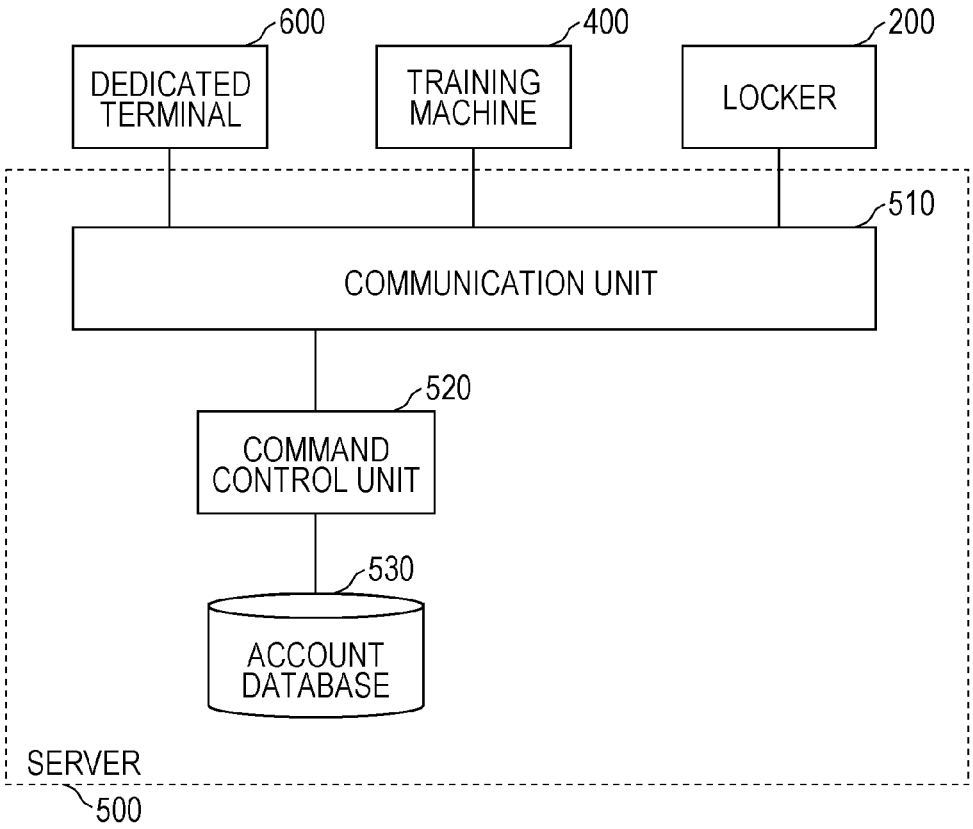
FIG. 7 is a block diagram illustrating the functional configuration of a server according to the embodiment.

FIG. 7 is a block diagram illustrating the functional configuration of the server 500 according to the embodiment.

The server 500 includes a communication unit 510, a command control unit 520, and an account database 530. The communication unit 510 receives a command type and information corresponding to the command type from the training machine 400 or the dedicated terminal 600 and transmits the received information to the command control unit 520. Next, the command control unit 520 updates the content of the account database 530 in accordance with the command type and transmits a result of the update to the communication unit 510 in accordance with the result of the update. The communication unit 510 transmits the result of the update to the training machine 400 or the dedicated terminal 600 in accordance with the content of the result of the update.

The configuration of the server 500 has been described.

Next, the configuration of the dedicated terminal 600 will be described.

Figure 8A:
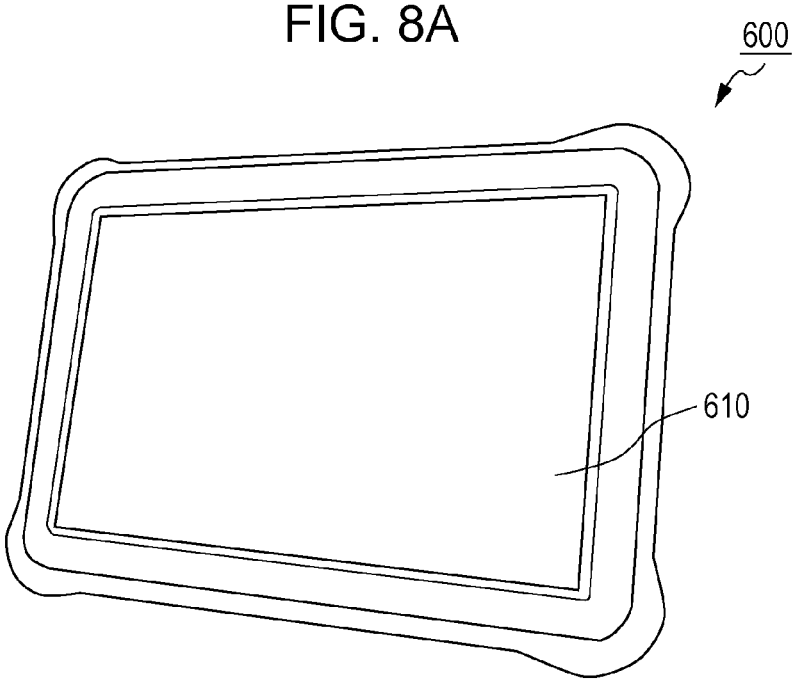
FIGS. 8A and 8B are diagrams illustrating the appearance of a dedicated terminal according to the embodiment.
Figure 8B:
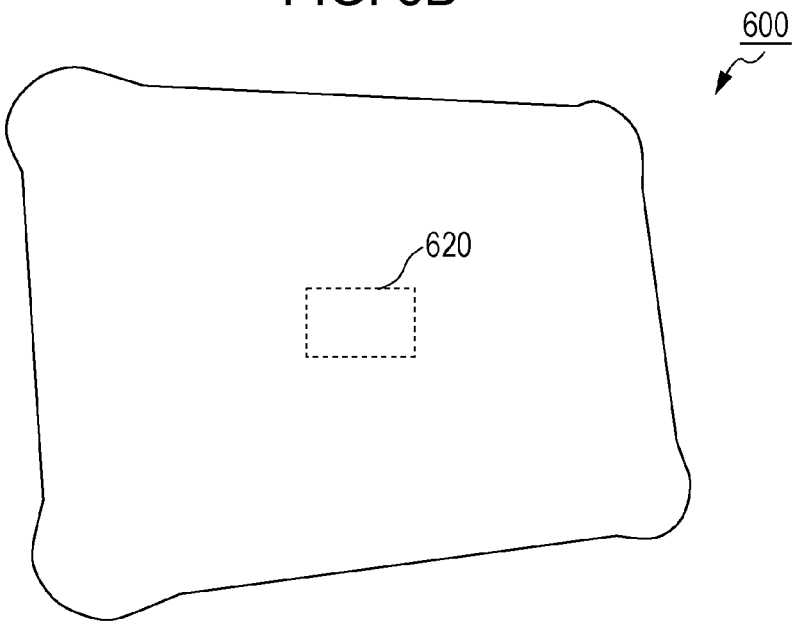

FIGS. 8A and 8B are diagrams illustrating the appearance of the dedicated terminal 600 according to the embodiment. More specifically, FIG. 8A is a perspective view of a front surface of the dedicated terminal 600. FIG. 8B is a perspective view of a back surface of the dedicated terminal 600. A user input screen is displayed on the front surface of the dedicated terminal 600, and a user interface unit 610 is provided. More specifically, the user interface unit 610 is a touch panel capable of receiving touch inputs from the user and displaying the user input screen and the like. On the other hand, an ID detection unit 620 is mounted on the back surface of the user interface unit 610 and obtains an ID of a nearby NFC tag or card.

Figure 9:
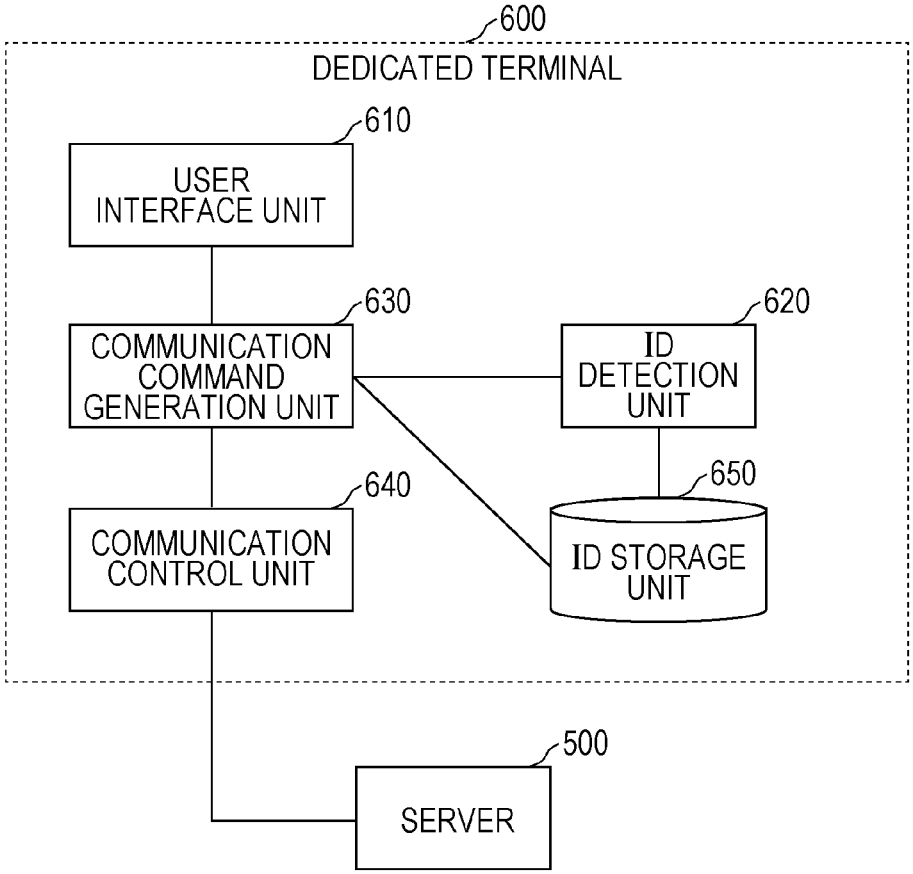
FIG. 9 is a block diagram illustrating the functional configuration of the dedicated terminal according to the embodiment.

FIG. 9 is a block diagram illustrating the functional configuration of the dedicated terminal 600 according to the embodiment.

The dedicated terminal 600 includes the user interface unit 610, the ID detection unit 620, a communication command generation unit 630, a communication control unit 640, and an ID storage unit 650.

If information such as a name, age, gender, or the like is input through an operation performed by the user, the user interface unit 610 obtains the input information and transmits the information to the communication command generation unit 630.

The ID detection unit 620 detects approach of a medium on which an ID is recorded, such as an NFC tag or a card, and, after obtaining the ID from the detected medium, stores the obtained ID in the ID storage unit 650 and notifies the communication command generation unit 630 that the ID has been obtained.

After the ID detection unit 620 notifies the communication command generation unit 630 that the ID has been obtained, the communication command generation unit 630 enables the user interface unit 610 to receive inputs. More specifically, the communication command generation unit 630 enables the user interface unit 610 to receive inputs by displaying the user input screen on the user interface unit 610. In addition, after the user interface unit 610 receives information, the user interface unit 610 transmits the input information to the communication command generation unit 630. Furthermore, after the user interface unit 610 receives input information indicating deletion of registered information, the user interface unit 610 transmits the input information indicating the deletion of the registered information to the communication command generation unit 630.

After the communication command generation unit 630 receives a notification or information, the communication command generation unit 630 generates a command in accordance with an obtained ID or the input information and transmits the command to the communication control unit 640. Upon receiving the command from the communication command generation unit 630, the communication control unit 640 transmits the command to the server 500.

The configuration of the dedicated terminal 600 has been described.

Next, the configuration of the training machine 400 will be described.

Figure 10:
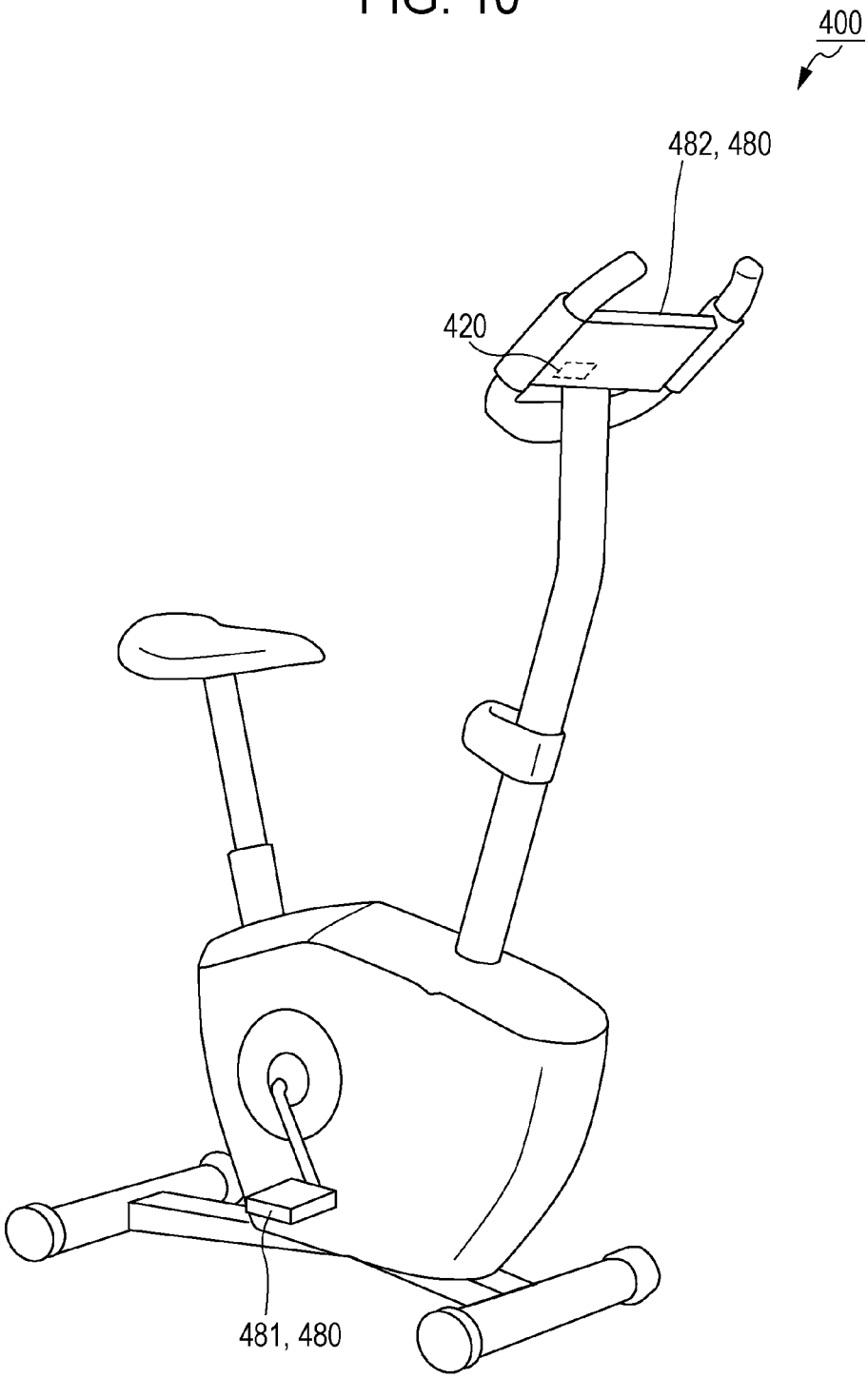
FIG. 10 is a diagram illustrating the appearance of a training machine according to the embodiment.
Figure 11:
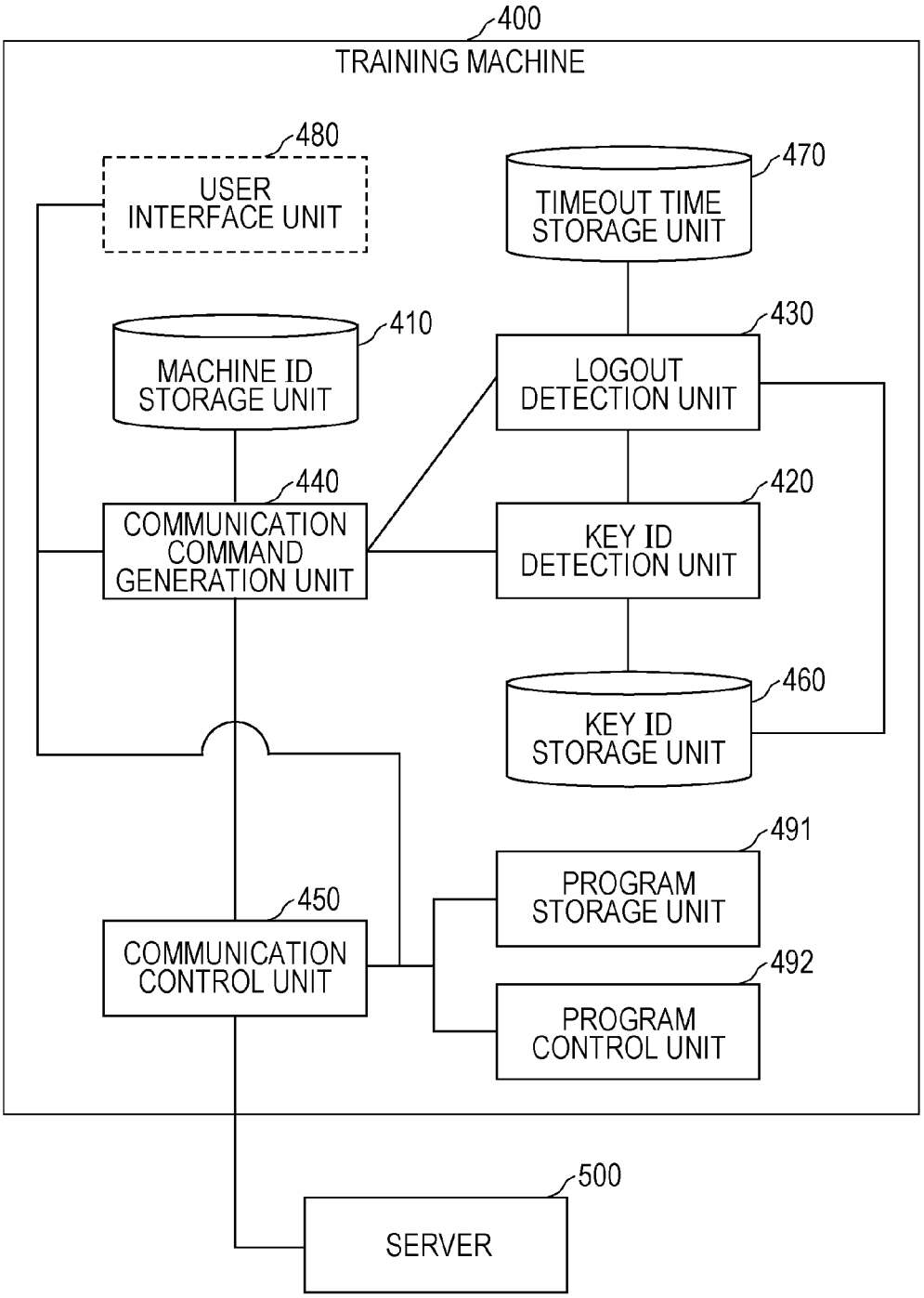
FIG. 11 is a block diagram illustrating the functional configuration of the training machine according to the embodiment.

FIG. 10 is a diagram illustrating the appearance of the training machine 400 according to the embodiment. FIG. 11 is a block diagram illustrating the functional configuration of the training machine 400 according to the embodiment.

The training machine 400 according to the embodiment is, for example, a stationary bicycle. The training machine 400 includes a machine ID storage unit 410, a key ID detection unit 420, a logout detection unit 430, a communication command generation unit 440, a communication control unit 450, a key ID storage unit 460, a timeout time storage unit 470, a user interface unit 480, a program storage unit 491, and a program control unit 492.

The machine ID storage unit 410 is a memory that stores a machine ID for identifying the training machine 400.

The key ID detection unit 420 detects approach of a medium (for example, the medium 330) on which a key ID is recorded, such as an NFC tag or a card, and upon obtaining the key ID, stores the obtained key ID in the key ID storage unit 460 and notifies the communication command generation unit 440 that the key ID has been obtained. That is, the key ID detection unit 420 is a reading unit that, when the key 300 enters a certain range around the training machine 400, reads the key ID from the key 300.

Upon receiving the key ID from the key ID detection unit 420, the communication command generation unit 440 reads the machine ID stored in the machine ID storage unit 410 and the key ID and transmits the machine ID and the key ID to the communication control unit 450.

The communication control unit 450 transmits the received machine ID and key ID to the server 500. That is, the communication control unit 450 is a communication circuit that outputs a machine ID and a key ID. The key ID storage unit 460 stores "null" as an initial value.

If the key ID detection unit 420 detects a key ID different from the key ID stored in the key ID storage unit 460, the logout detection unit 430 according to the embodiment notifies the communication command generation unit 440 that logout has occurred. In the timeout time storage unit 470, a value indicating "two hours" is written as a predetermined value. The logout detection unit 430 has a timer function and, if the time stored in the timeout time storage unit 470 has elapsed since the key ID detection unit 420 obtained a key ID, notifies the communication command generation unit 440 that logout has occurred.

The user interface unit 480 includes a measurement section 481 for measuring the amount of training of the user and a touch panel 482 (display) capable of receiving inputs from the user and displaying history information indicating use of the training machine 400. In this embodiment, the measurement section 481 includes pedals and a detection portion that detects the number of revolutions of the pedals.

It is to be noted that the touch panel 482 of the training machine 400 includes the machine ID storage unit 410, the key ID detection unit 420, the logout detection unit 430, the communication command generation unit 440, the communication control unit 450, the key ID storage unit 460, and the timeout time storage unit 470.

The program storage unit 491 is a memory storing training programs. The program control unit 492 is a control unit that reads a training program from the program storage unit 491 and that controls the training machine 400 on the basis of the read training program. After the user logs in to the training machine 400, the program control unit 492 reads a training program from the program storage unit 491 and activates the training program. After the training program is activated, the program control unit 492 displays an image on the touch panel 482.

The configuration of the training machine 400 has been described.

Next, the configuration of the account database 530 will be described with reference to FIG. 12.

Figure 12:
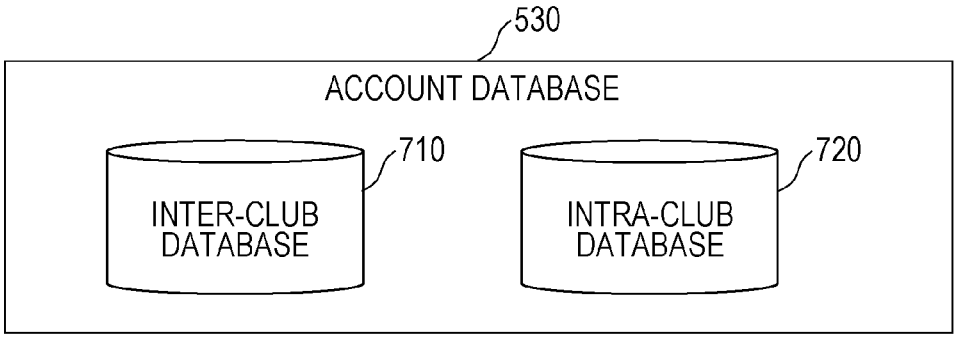
FIG. 12 is a diagram illustrating the configuration of an account database according to the embodiment.

FIG. 12 is a diagram illustrating the configuration of the account database 530 according to the embodiment.

The account database 530 includes an inter-club database 710 and an intra-club database 720. The inter-club database 710 stores information shared by clubs located in various regions, such as customers' personal information. On the other hand, the intra-club database 720 stores information used only in a corresponding club, such as machine IDs of the training machines 400 installed in the club and locker IDs of the lockers 200.

Next, the configuration of the inter-club database 710 will be described.

Figure 13:
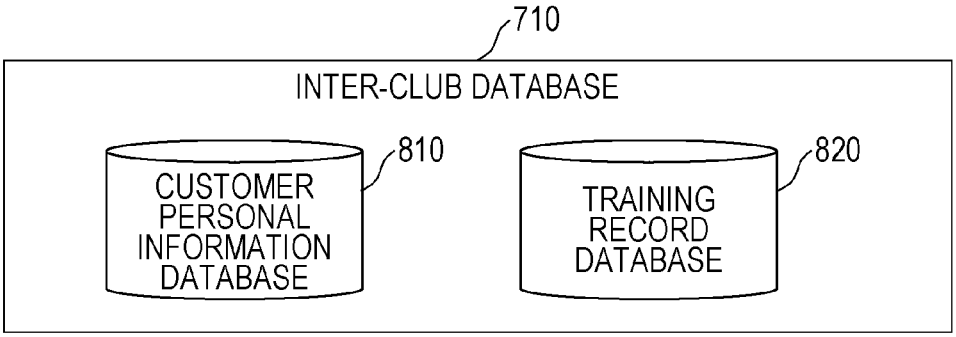
FIG. 13 is a diagram illustrating the configuration of an inter-club database according to the embodiment.

FIG. 13 is a diagram illustrating the configuration of the inter-club database 710 according to the embodiment.

The inter-club database 710 includes a customer personal information database 810 and a training record database 820.

FIG. 14 is a table illustrating an example of the content of the customer personal information database 810 according to the embodiment.

As illustrated in FIG. 14, the customer personal information database 810 at least includes user IDs 811 and also includes names 812, ages 813, and genders 814 as personal information. The customer personal information database 810 stores a plurality of customers' personal information associated with the user IDs 811. In this embodiment, each user ID 811 is IDm used in NFC communication, that is, eight 8-bit values. The name 812 indicates the name of a user corresponding to each user ID 811. The age 813 indicates the age of the user corresponding to each user ID 811. The gender 814 indicates the gender of the user corresponding to each user ID 811.

FIG. 15 is a table illustrating an example of the content of the training record database 820 according to the embodiment.

As illustrated in FIG. 15, the training record database 820 is a second database that includes user IDs 821, last training dates 822, average training times of the month 823, and average training pulses of the month 824 and that manages the history information indicating use of the training machine 400. In this embodiment, each user ID 821 is IDm used in NFC communication, that is, eight 8-bit values. The last training date 822 indicates a date on which a user corresponding to each user ID 821 trained last time. The average training time of the month 823 indicates a value obtained by dividing total time of training of the user corresponding to each user ID 821 in a current month by the number of dates of the month on which the user trained. The average training pulse of the month 824 indicates an average of pulses of the user corresponding to each user ID 821 measured during training in the current month.

Next, the configuration of the intra-club database 720 will be described.

Figures 16, 17:
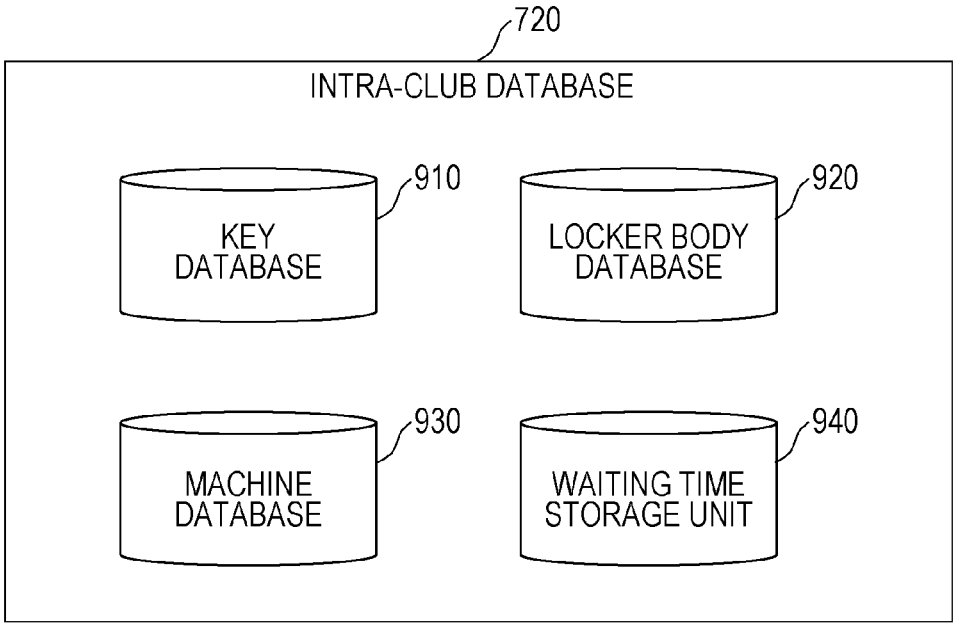
FIG. 16 is a diagram illustrating the configuration of an intra-club database according to the embodiment.
FIG. 17 is a table illustrating an example of the content of a key database according to the embodiment.

FIG. 16 is a diagram illustrating the configuration of the intra-club database 720 according to the embodiment.

The intra-club database 720 at least includes a key database 910, a locker body database 920, a machine database 930, and a waiting time storage unit 940. The waiting time storage unit 940 is a region that the server 500 can arbitrarily set and, in this embodiment, stores a value indicating "30 seconds" as an initial value.

Next, the configuration of the key database 910 will be described.

FIG. 17 is a table illustrating an example of the content of the key database 910 according to the embodiment.

The key database 910 is a first database including key IDs 911 and locker IDs 912. In this embodiment, each key ID 911 is IDm used in NFC communication, that is, eight 8-bit values. In addition, in this embodiment, each locker ID 912 is an address used in as an IP address, that is, four 8-bit values. The key database 910 stores combinations of the plurality of key IDs 911 and the plurality of locker IDs 912.

Each key ID 911 is individually associated with a key 300, and each locker ID 912 is individually associated with a locker 200. One of the plurality of lockers 200 is associated with one of the plurality of keys 300. Therefore, a locker ID 912 and a key ID 911 corresponding to a locker 200 and a key 300 capable of locking and unlocking the locker 200, respectively, are stored in the key database 910 as a combination.

In FIG. 17, for example, a key 300 to which a key ID 911 "219_134_127_211_113_0_39_1" is assigned is capable of locking and unlocking a locker 200 to which a locker ID "132.182.177.90" is assigned. In this embodiment, a key ID 911 is assigned to a key 300 after the key 300 is manufactured, and a locker ID 912 is assigned to a locker 200 after the locker 200 is manufactured. Furthermore, in this embodiment, the server 500, the keys 300, and the lockers 200 are provided as a set, and initial values of the key IDs 911 and the locker IDs 912 are set before the server 500, the keys 300, and the lockers 200 are provided such that the key IDs 911 and the locker IDs 912 match the provided keys 300 and lockers 200.

Next, the configuration of the locker body database 920 will be described.

FIG. 18 is a table illustrating an example of the content of the locker body database 920 according to the embodiment.

The locker body database 920 includes locker IDs 921 and user IDs 922. In this embodiment, each locker ID 921 is an address used as an IP address, that is, four 8-bit values. In addition, in this embodiment, each user ID 922 is IDm used in NFC communication, that is, eight 8-bit values. A user ID 922 and a locker ID 921 corresponding to a user card 100 and a locker 200 to which the user card 100 is attached (that is, a locker 200 including the card reading unit 240 into which the user card 100 is inserted), respectively, are stored in the locker body database 920 as a combination. If the value of a user ID 922 is "null", however, no user card 100 is attached to a locker 200 having a locker ID 921 corresponding to the user ID 922.

In FIG. 18, for example, a user card 100 to which a user ID 922 "219_134_127_211_113_0_39_1" is assigned is attached to a locker 200 having a locker ID 921 "132.182.177.90", that is, a user owning the user card 100 is using the locker 200.

In addition, in FIG. 18, since the value of the user ID 922 corresponding to a locker 200 whose locker ID 921 is "132.182.177.10" is "null", no user card 100 is attached to the locker 200. That is, the locker 200 is not locked (not being used) by any user.

Next, the configuration of the machine database 930 will be described.

FIG. 19 is a table illustrating an example of the content of the machine database 930 according to the embodiment.

The machine database 930 includes machine IDs 931 and user IDs 932. In this embodiment, each machine ID 931 is an address used as an IP address, that is, four 8-bit values. In addition, in this embodiment, each user ID 932 is IDm used in NFC communication, that is, eight 8-bit values. If a user owning a user card 100 is using a training machine 400, a user ID 932 and a machine ID 931 corresponding to the user card 100 owned by the user and the training machine 400 used by the user, respectively, are stored in the machine database 930 as a combination. If the value of a user ID 932 is "null", a training machine 400 of a machine ID 931 corresponding to the user ID 932 is not being used by any user. On the other hand, if a plurality of values of user IDs 932 are stored, a training machine 400 having a machine ID 931 corresponding to the user IDs 932 is being used by a plurality of users.

The configuration of the account database 530 has been described.

Next, a processing procedure performed by each component will be described in detail.

Figure 20:
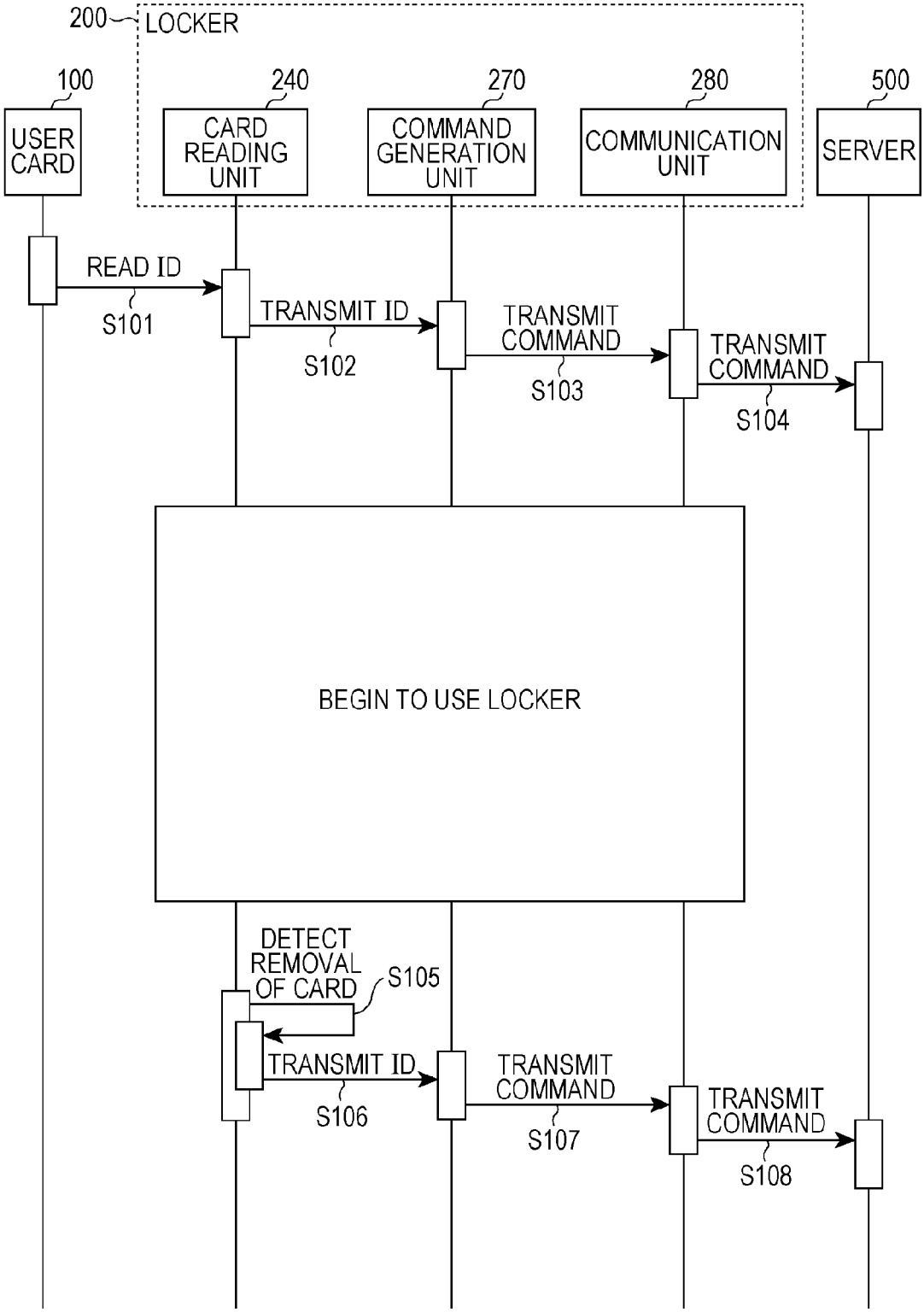
FIG. 20 is a sequence diagram illustrating a process for logging in to and logging out of the locker according to the embodiment.

A procedure of a process for logging in to and logging out of the locker 200 when the user card 100 is inserted into the card reading unit 240 of the locker 200 and then removed from the card reading unit 240 will be described with reference to FIG. 20.

First, a process performed after the user card 100 is inserted into the card reading unit 240 of the locker 200 will be described.

If the user card 100 is inserted into the card reading unit 240, the card reading unit 240 obtains the user ID from the user card 100 (S101). Next, the card reading unit 240 stores the obtained user ID in the user ID storage unit 250 and transmits the user ID to the command generation unit 270 (S102). Next, the command generation unit 270 generates a command, to which a parameter having the obtained user ID as an ID is added and to which the locker ID stored in the locker ID storage unit 260 is added as a parameter, for logging in to the locker 200 and transmits the generated command to the communication unit 280 (S103). The communication unit 280 transmits the obtained command to the server 500 (S104).

Next, a process performed when the user card 100 is removed from the locker 200 will be described.

If the card reading unit 240 detects that the user card 100 is removed from the card reading unit 240 (S105), the card reading unit 240 transmits the ID stored in the user ID storage unit 250, that is, the user ID, to the command generation unit 270 (S106). The command generation unit 270 transmits a command, to which a parameter having the obtained user ID as an ID is added and to which the locker ID stored in the locker ID storage unit 260 is added as a parameter, for logging out of the locker 200 to the communication unit 280 (S107). The communication unit 280 transmits the obtained command to the server 500 (S108).

Thus, as the processing in steps S101 to S104 is performed, the server 500 obtains, when the user card 100 is inserted into (the card reading unit 240 of) the locker 200, the locker ID and the user ID, through the communication unit 280, from the locker 200 into which the user card 100 is inserted.

The process performed by the locker 200 after the user card 100 is inserted into the locker 200 and then removed from the locker 200 has been described.

Figure 21:
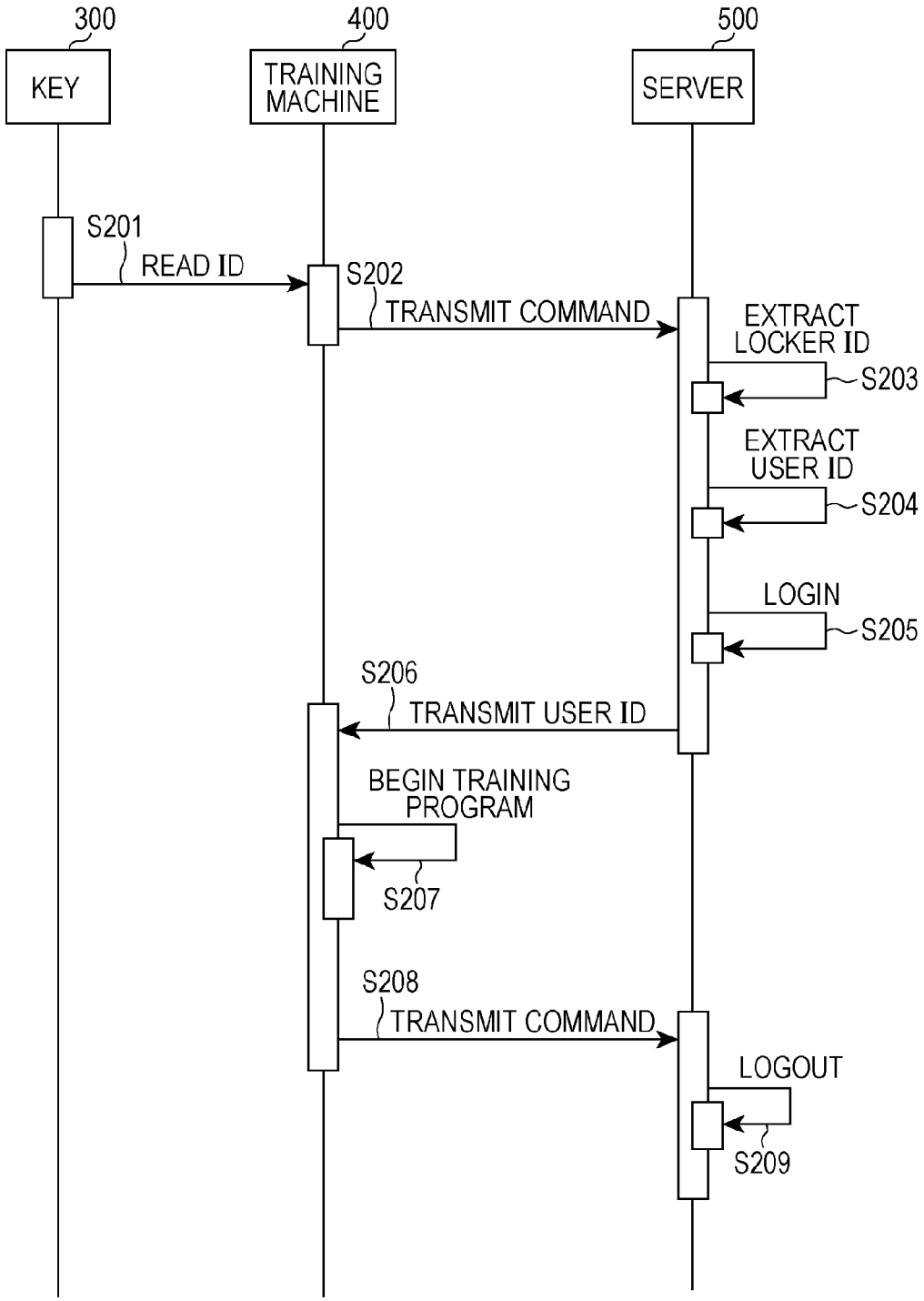
FIG. 21 is a sequence diagram illustrating a process for logging in to and logging out of the training machine according to the embodiment.

Next, a procedure of a process for logging in to and logging out of the training machine 400 performed by the account control system 300, the training machine 400, and the server 500 will be described with reference to FIG. 21.

If the key 300 approaches the key ID detection unit 420 of the training machine 400, the training machine 400 obtains the key ID from the key 300 (S201).

Next, the training machine 400 transmits a command, to which the obtained key ID and the machine ID assigned thereto in advance are added as parameters, for logging in to the training machine 400 to the server 500 (S202).

Upon receiving the command, the server 500 searches the key IDs 911 stored in the key database 910 illustrated in FIG. 17 for the key ID added to the command and, if the key ID is found, extracts a locker ID corresponding to the key ID from the locker IDs 912 (S203). Next, the server 500 searches the locker IDs stored in the locker body database 920 illustrated in FIG. 18 for the locker ID and, if the locker ID is found, extracts a user ID associated with the locker ID from the user IDs 922 (S204).

Next, the server 500 searches the machine IDs 931 stored in the machine database 930 illustrated in FIG. 19 for the machine ID added to the command and, if the machine ID is found, overwrites, among the user IDs 932, a user ID associated with the machine ID with the user ID associated with the locker ID to log in to the training machine 400 (S205). After the login process ends, the server 500 transmits the user ID to the training machine 400 (S206).

Upon receiving the server 500, the training machine 400 begins a training program (S207). When the training program has ended, the training machine 400 transmits a command, to which the machine ID associated with the training machine 400 is added as a parameter, for logging out of the training machine 400 to the server 500 (S208).

Upon receiving the command, the server 500 searches the machine IDs 931 stored in the machine database 930 illustrated in FIG. 19 for the machine ID added to the command and, if the machine ID is found, overwrites, among the user IDs 932, a user ID associated with the machine ID with "null" to log out of the training machine 400 (S209).

Thus, by transmitting the user ID to the training machine 400 in step S206, the server 500 enables the user corresponding to the user ID to use a training program on the training machine 400. It is to be note that "enables the user corresponding to the user ID to use a training program on the training machine 400" here means that a training program (application) stored in the program storage unit 491 of the training machine 400 is read and the program control unit 492 associates the training program with the user ID of the user who has logged in to the training machine 400 to enable the user to use the training program.

As a result of the above process, the process for logging in to and logging out of the training machine 400 is realized.

Figure 22:
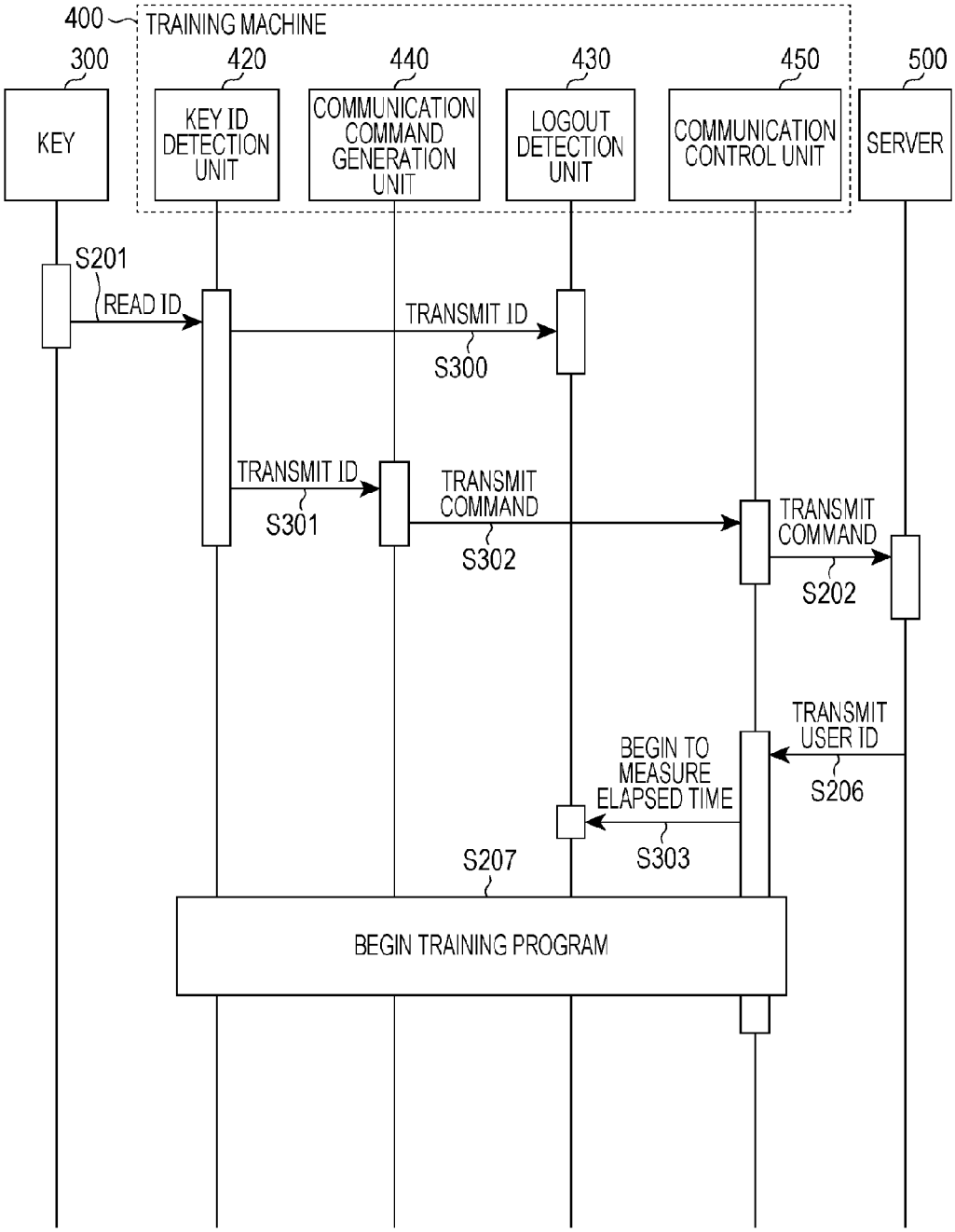
FIG. 22 is a sequence diagram illustrating a process performed by the training machine according to the embodiment.

Next, a process performed by the training machine 400 will be described in more detail with reference to FIG. 22. The same steps as those illustrated in FIG. 21 are given the same reference numerals in FIG. 22.

If the key 300 approaches the key ID detection unit 420 of the training machine 400, the key ID detection unit 420 reads the key ID from the holding unit 321 of the medium 330 of the key 300 through the communication unit 322 (S201) and transmits the read key ID to the logout detection unit 430 (S300). Next, the key ID detection unit 420 stores the read key ID in the key ID storage unit 460 and transmits the read key ID to the communication command generation unit 440 (S301). Upon obtaining the key ID, the communication command generation unit 440 transmits a command, to which the obtained key ID and the machine ID stored in the machine ID storage unit 410 are added as parameters, for logging in to the training machine 400 to the communication control unit 450. Upon receiving the command, the communication control unit 450 transmits the obtained command to the server 500 (S202). If the communication control unit 450 receives a user ID from the server 500 (S206) after transmitting the command to the server 500, the communication control unit 450 issues a start request to begin to measure elapsed time to the logout detection unit 430 to begin a training program (S207). Upon receiving the start request, the logout detection unit 430 begins to measure the elapsed time (S303).

Figure 23:
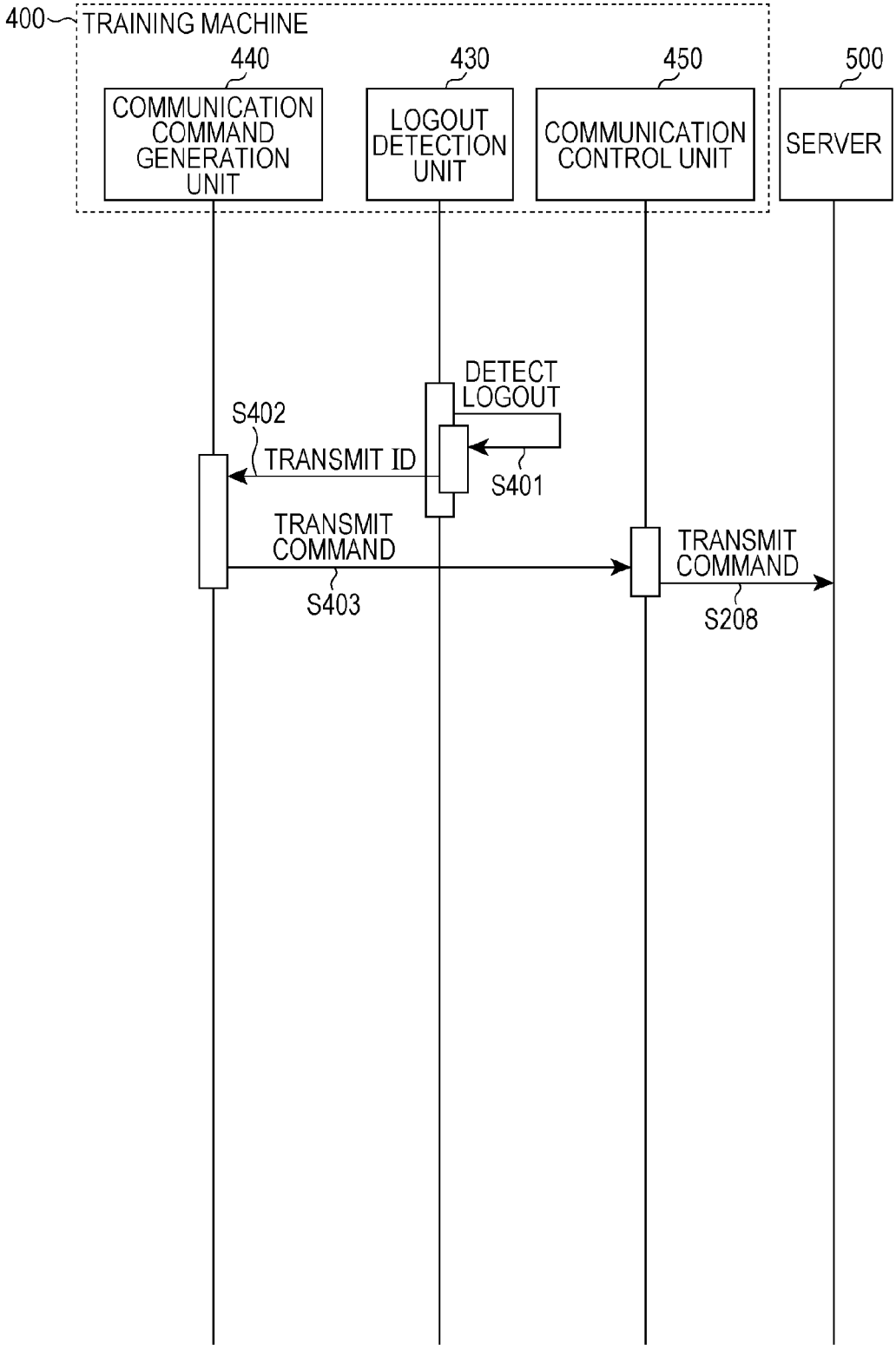
FIG. 23 is a sequence diagram illustrating a process performed after the training machine detects logout according to the embodiment.

Next, a process performed by the training machine 400 after the logout detection unit 430 detects logout will be described with reference to FIG. 23.

If the logout detection unit 430 detects logout (S401), the logout detection unit 430 transmits the key ID stored in the key ID storage unit 460 to the communication command generation unit 440 (S402). The communication command generation unit 440 transmits a command, to which the obtained key ID is added as a parameter, for logging out of the training machine 400 to the communication control unit 450 (S403). Upon receiving the command, the communication control unit 450 transmits the obtained command to the server 500 (S208).

The procedure of the process for logging in to and logging out of the training machine 400 performed by the key 300, the training machine 400, and the server 500 has been described.

Figure 24:
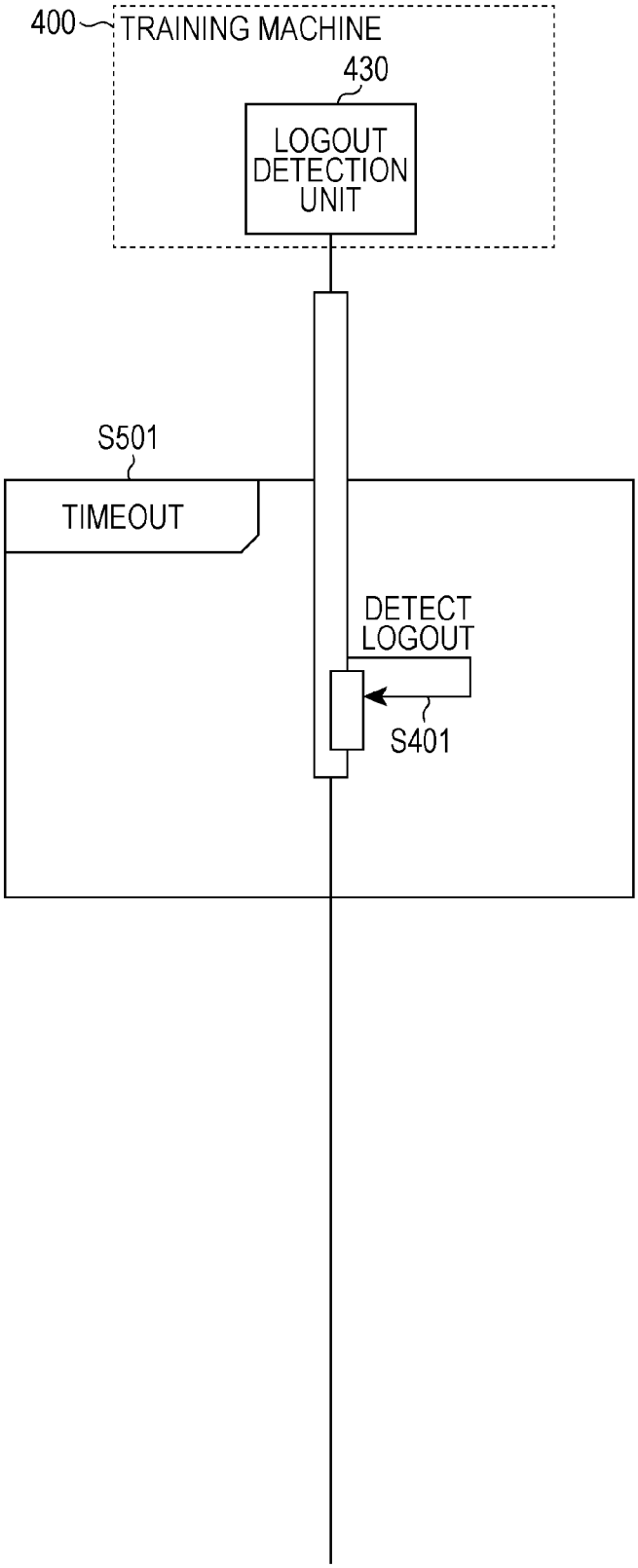
FIG. 24 is a sequence diagram illustrating a procedure of a process for detecting logout due to timeout after login according to the embodiment.

Next, a procedure of a process for detecting logout due to timeout after login to the training machine 400 will be described with reference to FIG. 24.

If the logout detection unit 430 detects that time ("two hours" in this embodiment) indicated by the value stored in the timeout time storage unit 470 has elapsed since the measurement of the elapsed time began in S303 (S501), the logout detection unit 430 issues a logout notification to itself (S401).

Figure 25:
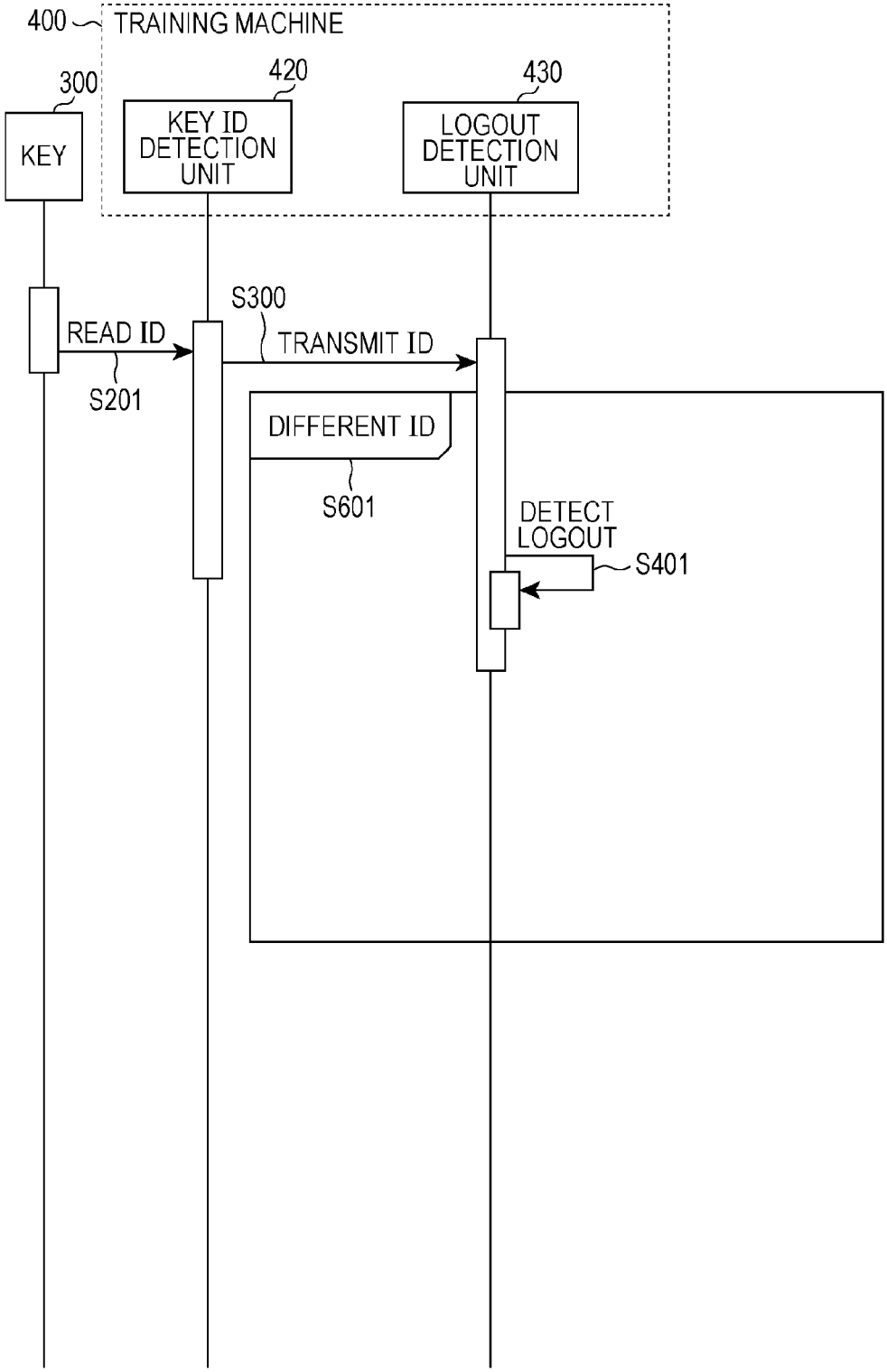
FIG. 25 is a sequence diagram illustrating a procedure of a process for detecting logout due to notification of a key identifier (ID) according to the embodiment.

Next, a procedure of a process for detecting logout due to notification of a key ID will be described with reference to FIG. 25.

If the key 300 approaches the key ID detection unit 420 and the key ID detection unit 420 obtains the key ID from the key 300 (S201), the key ID detection unit 420 transmits the key ID to the logout detection unit 430 (S300). At this time, the logout detection unit 430 determines whether the obtained key ID and the key ID stored in the key ID storage unit 460 are different from each other. If so (S601), the logout detection unit 430 determines that a new user has logged in, and issues a logout notification to itself (S401).

That is, the logout process performed by the training machine 400 may be performed when two hours has elapsed since a training program began or may be performed after detecting a different key ID.

The procedure for detecting logout performed by the training machine 400 according to the embodiment has been described.

The information management system 10 performs the following process in the method for managing information.

Figure 26:
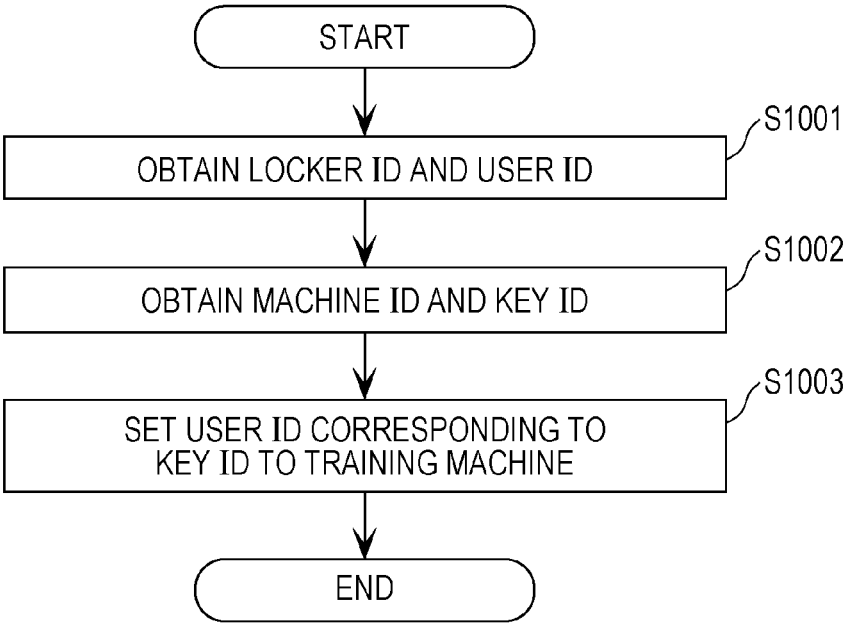
FIG. 26 is a flowchart illustrating a method for managing information according to the embodiment.

FIG. 26 is a flowchart illustrating the method for managing information according to the embodiment.

First, the locker ID and the user ID are obtained, through the communication unit 280, from the locker 200 into which the user card 100 is inserted (S1001).

Next, the machine ID and the key ID are obtained, through the communication control unit 450, from the training machine 400 that has read the key ID (that is, reading of the key ID has been performed) (S1002).

Finally, using the key database 910 that manages locker IDs and key IDs by associating the locker IDs and the key IDs with each other and the obtained locker ID and user ID, a user ID corresponding to the key ID is output to the training machine 400 and set to the training machine 400 (S1003).

Figure 27:
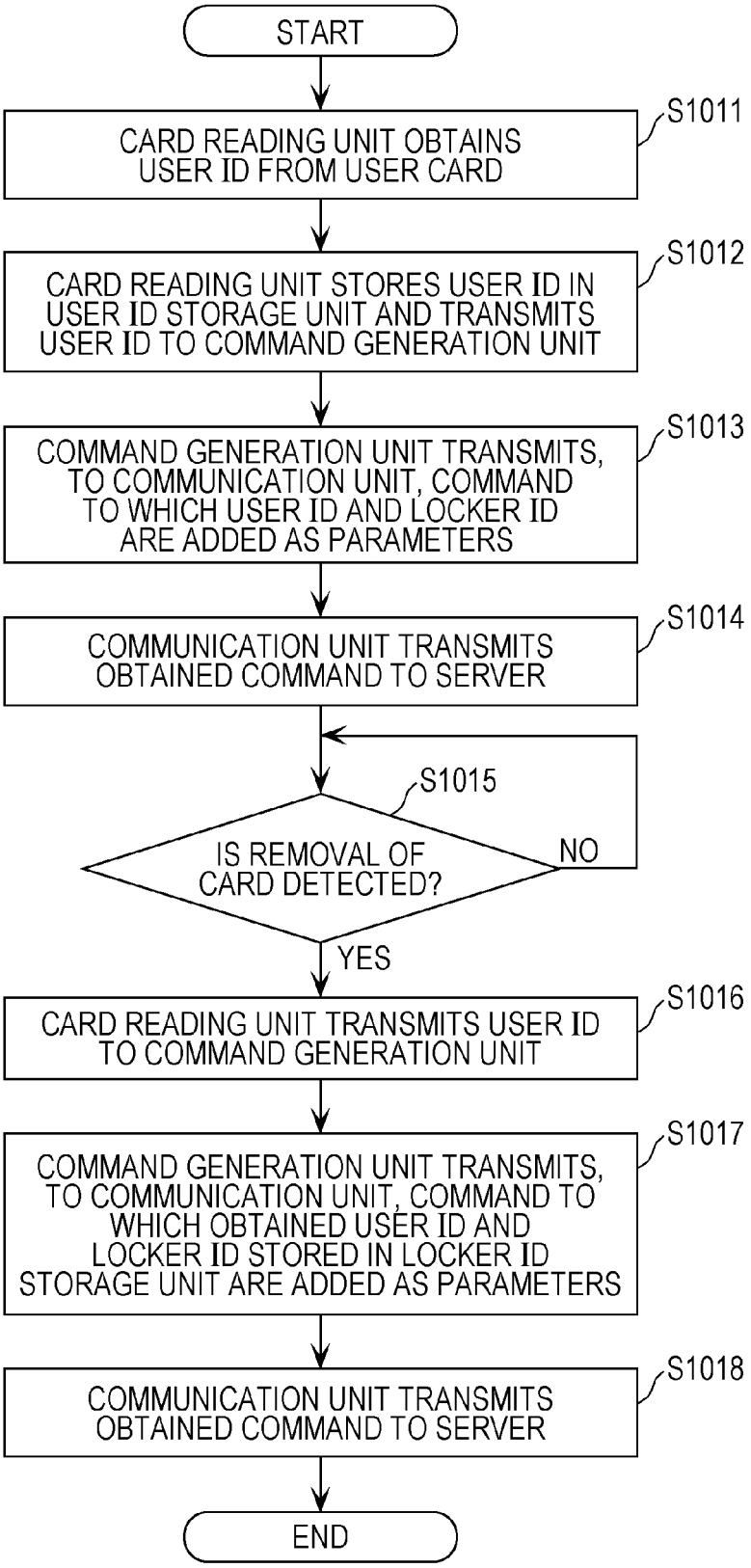
FIG. 27 is a flowchart illustrating a procedure for logging in to and logging out of the locker according to the embodiment.

FIG. 27 is a flowchart illustrating a procedure for logging in to and logging out of the locker 200 according to the embodiment.

First, the card reading unit 240 obtains the user ID from the user card 100 (S1011).

Next, the card reading unit 240 stores the obtained user ID in the user ID storage unit 250 and transmits the user ID to the command generation unit 270 (S1012).

The command generation unit 270 transmits a command to which the user ID and the locker ID are added as parameters to the communication unit 280 (S1013).

The communication unit 280 transmits the obtained command to the server 500 (S1014).

Next, the card reading unit 240 determines whether removal of the user card 100 has been detected (S1015). If the card reading unit 240 detects removal of the user card 100, the process proceeds to step S1016. If the card reading unit 240 does not detect removal of the user card 100, the processing in step S1015 is repeated.

Next, the card reading unit 240 transmits the user ID to the command generation unit 270 (S1016).

The command generation unit 270 transmits a command to which the obtained user ID and the locker ID stored in the locker ID storage unit 260 are added as parameters to the communication unit 280 (S1017).

Finally, the communication unit 280 transmits the obtained command to the server 500 (S1018).

Thus, as the locker 200 performs the processing in steps S1011 to S1014, the server 500 can obtain the locker ID and the user ID as in step S1001.

Figure 28:
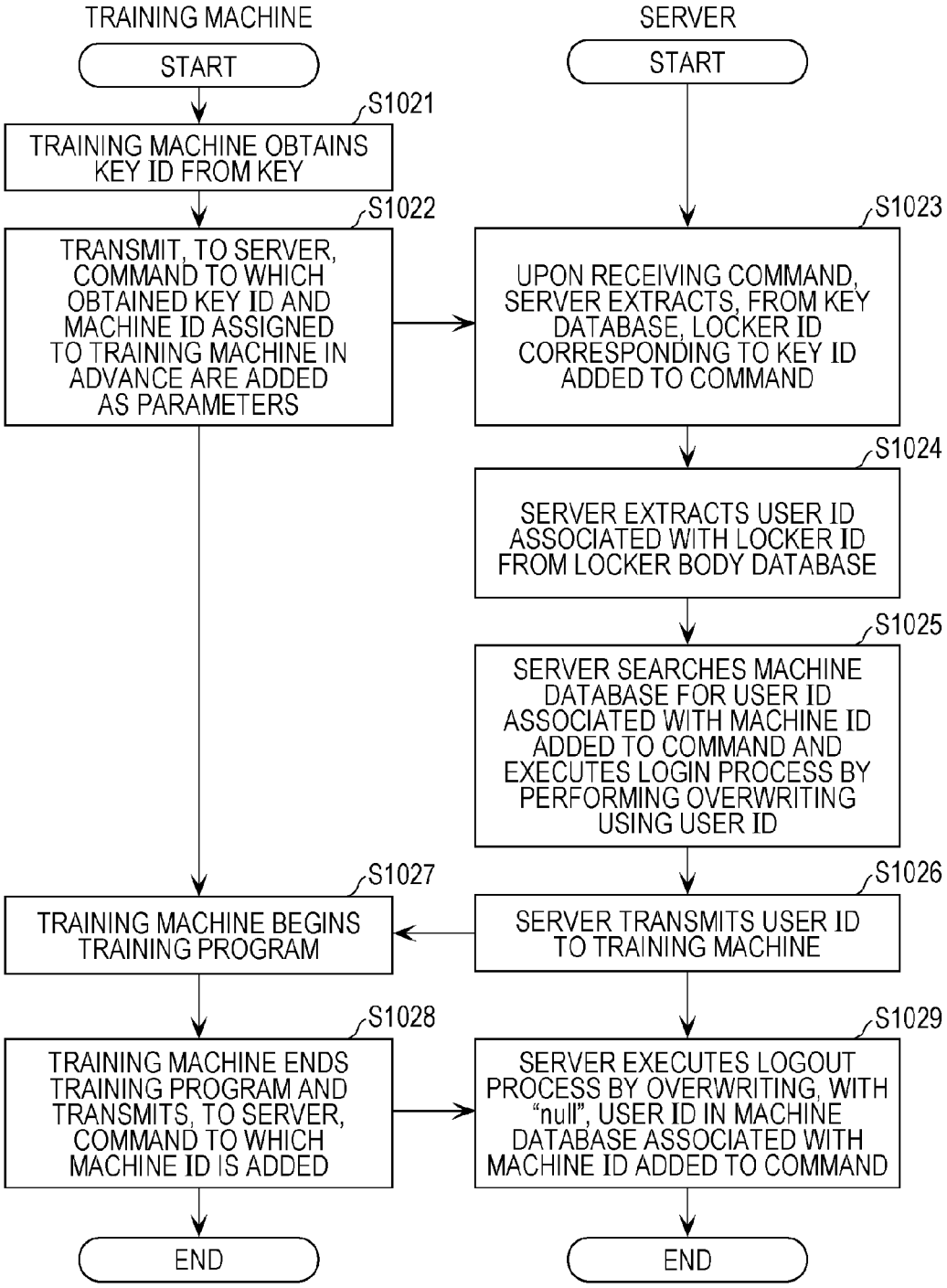
FIG. 28 is a flowchart illustrating a procedure for logging in to and logging out of the training machine according to the embodiment.

FIG. 28 is a flowchart illustrating a procedure of a process for logging in to and logging out of the training machine 400 according to the embodiment.

First, the training machine 400 obtains the key ID from the key 300 (S1021).

Next, the training machine 400 transmits a command to which the obtained key ID and the machine ID assigned to the training machine 400 in advance to the server 500 (S1022).

The training machine 400 then waits until a user ID is received from the server 500.

On the other hand, upon receiving the command from the training machine 400, the server 500 extracts (identifies), from the key database 910, a locker ID corresponding to the key ID added to the command (S1023).

Next, the server 500 extracts (identifies), from the locker body database 920, a user ID associated with the locker ID (S1024).

Next, the server 500 searches the machine database 930 for a user ID associated with the machine ID added to the command and performs overwriting with the identified user ID to perform a login process (S1025).

Next, the server 500 transmits the identified user ID to the training machine 400 (S1026).

The server 500 then waits until a command is received from the training machine 400.

Upon receiving the user ID from the server 500, the training machine 400 begins a training program (S1027).

The training machine 400 then ends the training program and transmits a command to which the machine ID is added to the server 500 (S1028).

Upon receiving the command to which the machine ID is added from the training machine 400, the server 500 overwrites, in the machine database 930, a user ID associated with the machine ID added to the command with "null" to perform a logout process (S1029).

Thus, as the training machine 400 performs the processing in steps S1021 and S1022, the server 500 can obtain the machine ID and the key ID as in step S1002. By performing the processing in steps S1023 to S1025, the server 500 performs the processing in step S1003.

As described above, according to the method for managing information according to the embodiment, even if the user card 100 storing the user ID indicating the user is inserted into the locker 200 and therefore not available and the user carries the key 300 storing the key ID, not the user ID, and uses the training machine 400, the user ID and the key ID are automatically associated with each other through the locker ID indicating the locker 200 without a process performed by the person at a front desk or the user. Therefore, the user can set the user ID to the training machine 400 just by making the training machine 400 read the key ID.

In addition, the information management system 10 according to the embodiment obtains the machine ID and the key ID from the training machine 400 and sets the user ID corresponding to the key ID to the training machine 400 using the key database 910 (first database) that manages locker IDs and key IDs by associating the locker IDs and the key IDs with each other and the obtained locker ID and user ID. Therefore, for example, the sport gym can automatically identify the association between the user and the training machine 400 used by the user.

In addition, according to the method for managing information according to the embodiment, by setting the user ID to the training machine 400, the user corresponding to the user ID may be enabled to use a training program on the training machine 400. Therefore, even if the user card 100 storing the user ID indicating the user is inserted into the locker 200 and therefore not available, the user can obtain the user's history information indicating use of the training machine 400 just by making the training machine 400 read the key ID of the key that the user carries, without performing a troublesome process.

According to the method for managing information according to the embodiment, IDm used in near field communication may be used as a key ID. Therefore, the user can set the user ID to the training machine 400 just by bringing the key 300 of the locker 200 closer to the training machine 400.

According to the method for managing information according to the embodiment, IDm used in near field communication may be used as a user ID. Therefore, just by inserting the user card 100 into the locker 200, the user can transmit the user ID to the information management system 10 from the locker 200.

According to the method for managing information according to the embodiment, if the key ID detection unit 420 detects the key 300, the machine ID and the key ID may be obtained, through the communication control unit 450 (second communication circuit), from the training machine 400 that has read the key ID. Therefore, the user can set the user ID to the training machine 400 just by bringing the key 300 of the locker 200 closer to the training machine 400.

According to the method for managing information according to the embodiment, for example, the key 300 may include the key portion 310 and the belt portion 320, and the belt portion 320 may include the holding unit 321 for a key ID and the communication unit 322 for transmitting the key ID. Therefore, even if the key 300 holds the key ID and has a function of transmitting the key ID, the configuration of the key 300 is simple. Accordingly, the key 300 can be light, and, for example, even if the user wears the key 300 around his/her wrist and uses the training machine 400, it is possible to prevent the key 300 from disturbing the user during exercise using the training machine 400.

In addition, when the user card 100 is inserted into the locker 200 and removed from the locker 200, the server 500 may record the times and the user ID obtained from the user card 100, in order to manage times at which the user enters and left the locker room.

In addition, the stationary bicycle taken as an example of the training machine 400 may transmit training information to the server 500, such as training time, an average number of revolutions of the pedals, a maximum number of revolutions of the pedals, an average pulse, and maximum and minimum pulses. The server 500 may then store these pieces of information in the training record database 820 while associating these pieces of information with the user ID.

Figure 29:
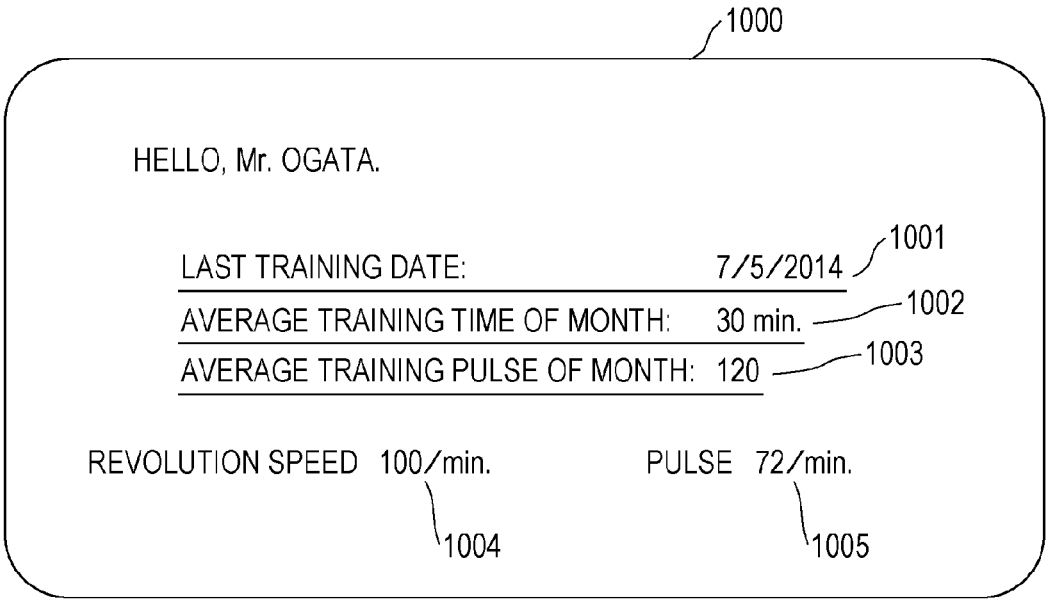
FIG. 29 is a diagram illustrating an example of a screen showing history information to be displayed on a touch panel of the training machine according to the embodiment.

As a result, the touch panel 482 of the training machine 400 or the dedicated terminal 600 may obtain the recorded information from the training record database 820 of the server 500 and, as illustrated in FIG. 29, suggest the information to the user using a screen 1000 showing the information. That is, the information management system 10 may output history information corresponding to the user ID to the training machine 400 and display the history information on the touch panel 482 of the training machine 400 using the training record database 820, which manages the history information indicating how the user indicated by the user ID identified at the time of login to the training machine 400 has used the training machine 400.

The screen 1000 includes a last training date 1001, average training time of the month 1002, an average training pulse of the month 1003, a revolution speed of the pedals 1004, and a pulse 1005.

Such a login function and a recording function may be incorporated into various training machines as well as the stationary bicycle.

Modifications

First Modification

A locker 200*a* according to a first modification will be described with reference to FIG. 30.

Figure 30:
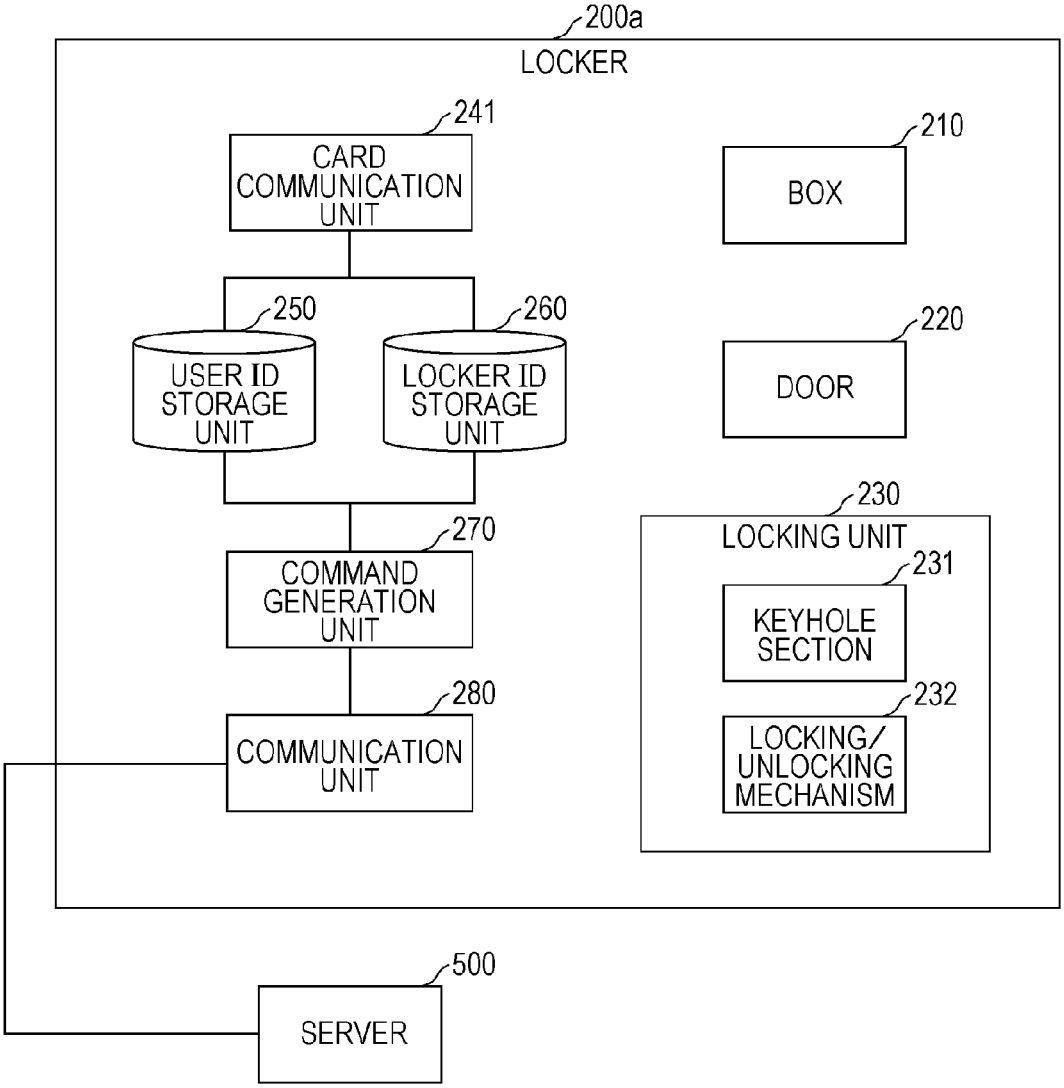
FIG. 30 is a block diagram illustrating an example of the functional configuration of a locker according to a first modification.

FIG. 30 is a block diagram illustrating an example of the functional configuration of the locker 200*a* according to the first modification.

The locker 200*a* according to the first modification is different from the locker 200 according to the embodiment in that a card communication unit 241 is used instead of the card reading unit 240. The same components as those of the locker 200 according to the embodiment are given the same reference numerals as those used for the components of the locker 200 according to the embodiment, that is, the reference numerals illustrated in FIG. 4.

In the locker 200 according to the embodiment, the card reading unit 240 has the function of reading an ID from a tag or a card such as that of NFC or FeliCa (registered trademark). On the other hand, the card communication unit 241 of the locker 200*a* according to the first modification is capable of performing a process for transmitting data to a near field communication device such as an NFC reader or a FeliCa reader, as well as realizing the same function as the card reading unit 240. This function is realized by, for example, an emulation mode of the NFC reader, but the device used is not limited to the NFC reader or the FeliCa reader.

Second Modification

In the embodiment, the locker 200 does not receive any ID from the key 300 (that is, communication between the locker 200 and the key 300 is not performed). Therefore, the locker 200 has a mechanism in which the locking/unlocking section 232 is locked by turning the key 300 inserted into the keyhole section 231 with the door 220 closed.

On the other hand, in a second modification, a locker 200*b* reads a key ID from a key 300*b*. That is, the locker 200*b* unlocks only while "the key ID assigned to the key 300*b* corresponding to the locker 200*b*" is received from the key 300*b*.

Figure 31:
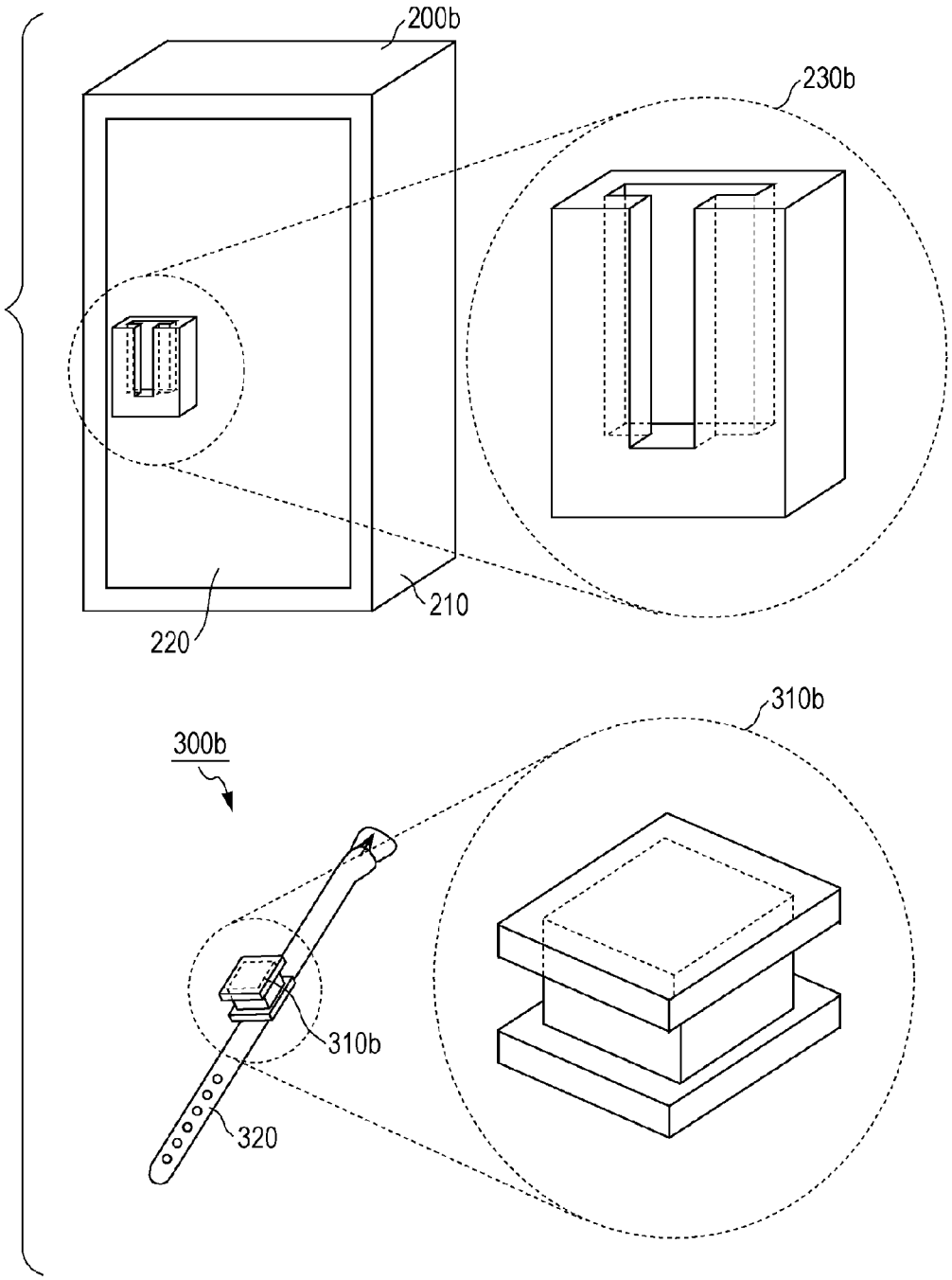
FIG. 31 is a diagram illustrating the appearances of a locker and a key according to a second modification.
Figure 32:
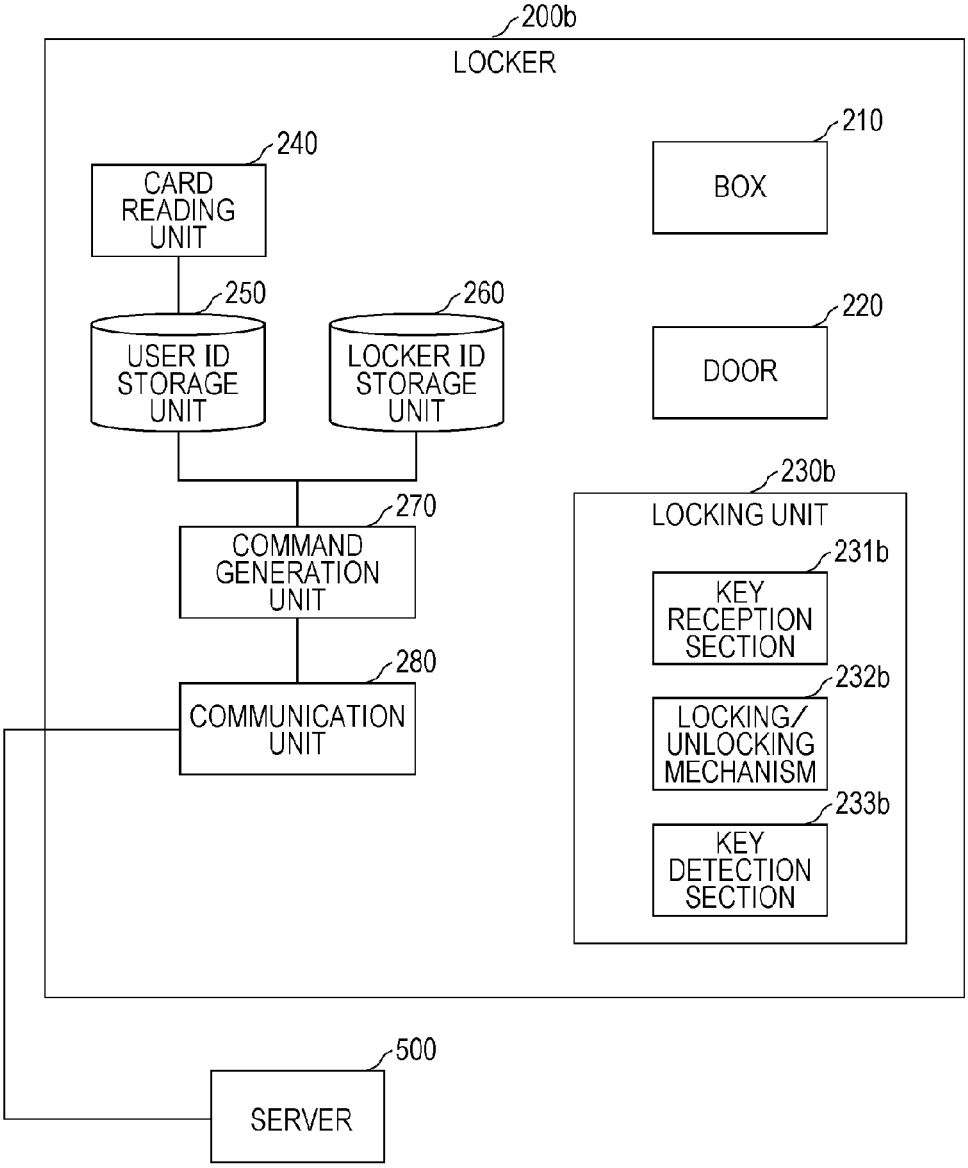
FIG. 32 is a block diagram illustrating an example of the functional configuration of the locker according to the second modification.
Figure 33:
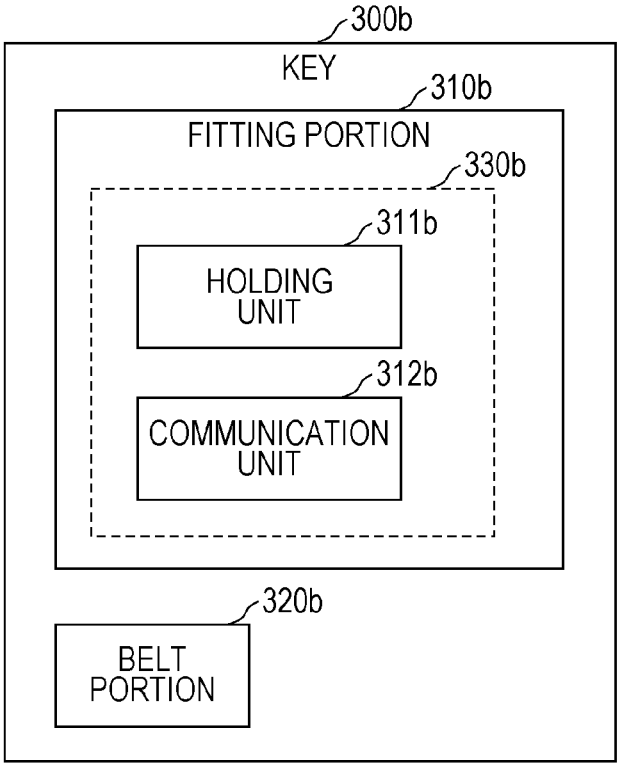
FIG. 33 is a block diagram illustrating an example of the functional configuration of the key according to the second modification.
Figure 34:
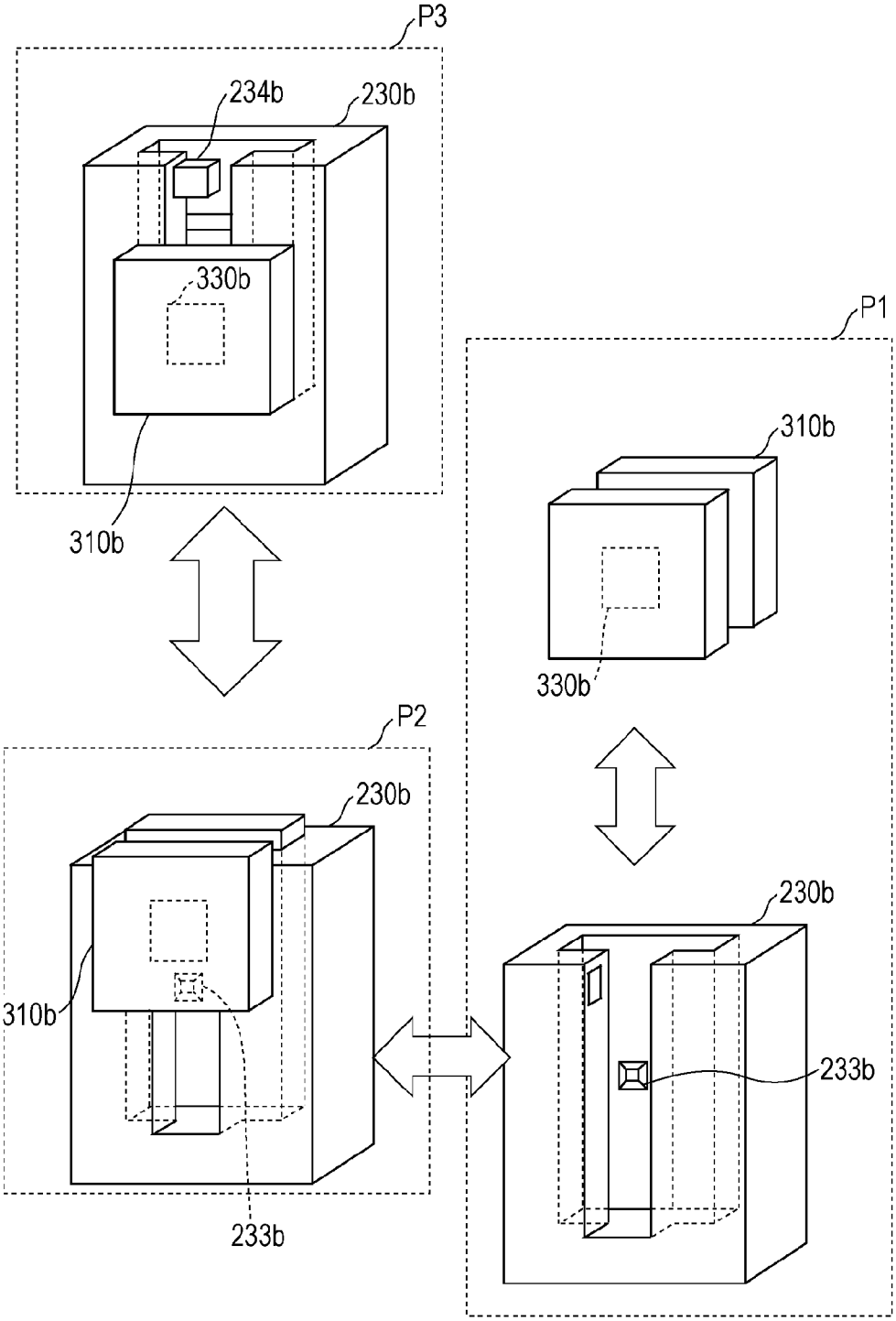
FIG. 34 is a diagram illustrating a locking unit of the locker in a locked state and an unlocked state according to the second modification.

FIG. 31 is a diagram illustrating the appearances of the locker 200*b* and the key 300*b* according to the second modification. FIG. 32 is a block diagram illustrating an example of the functional configuration of the locker 200*b* according to the second modification. FIG. 33 is a block diagram illustrating an example of the functional configuration of the key 300*b* according to the second modification. FIG. 34 is a diagram illustrating a locking unit 230*b* of the locker 200*b* according to the second modification in a locked state and in an unlocked state.

As illustrated in FIGS. 31 and 32, in the locker 200*b*, the configuration of the locking unit 230*b* is different from that of the locking unit 230 of the locker 200 according to the embodiment. The same components as those of the locker 200 according to the embodiment are given the same reference numerals as those of the locker 200 according to the embodiment, that is, the reference numerals illustrated in FIG. 4.

In addition, as illustrated in FIGS. 31 and 33, the key 300*b* is different from the key 300 according to the embodiment in that the key 300*b* includes a fitting portion 310*b* and a belt portion 320*b*. More specifically, the fitting portion 310*b* includes a medium (tag) 330*b* including a holding unit 311*b* that holds the key ID and a communication unit 312*b* capable of transmitting the key ID. In addition, unlike the belt portion 320 of the key 300 according to the embodiment, the belt portion 320*b* does not include the medium 330.

The locking unit 230*b* of the locker 200*b* includes a key reception section 231*b*, a locking/unlocking mechanism 232*b*, and a key detection section 233*b*. The key reception section 231*b* is a member provided on a front surface of the door 220 of the locker 200*b* and capable of arranging the fitting portion 310*b* of the key 300*b* at a certain position thereof with the fitting portion 310*b* inserted. The key reception section 231*b* is provided with the key detection section 233*b* capable of reading the key ID held by the medium 330*b* provided for the fitting portion 310*b* in a state in which the fitting portion 310*b* is arranged at the certain position (P3 of FIG. 34). That is, when the fitting portion 310*b* is inserted into the key reception section 231*b* and arranged at the certain position (P3 of FIG. 34), the medium 330*b* of the key 300*b* is arranged at a position at which the key detection section 233*b* provided for the key reception section 231*b* can read the medium 330*b*. When the medium 330*b* is arranged at the position at which the key detection section 233*b* can read the medium 330*b* (that is, when the fitting portion 310*b* is arranged at the certain position of the key reception section 231*b* (P3 of FIG. 34)), the locking/unlocking mechanism 232*b* unlocks. When the medium 330*b* is not arranged at the position at which the key detection section 233*b* can read the medium 330*b* (that is, when the fitting portion 310*b* is removed from the key reception section 231*b* (P1 and P2 of FIG. 34)), the locking/unlocking mechanism 232*b* locks.

As illustrated in P3 of FIG. 34, a key stop section 234*b* for preventing the fitting portion 310*b* from being removed from the key reception section 231*b* may be provided. In the unlocked state, the key stop section 234*b* protrudes so that the fitting portion 310*b* cannot be removed (refer to P3 of FIG. 34). In the locked state, the key stop section 234*b* recedes so that the fitting portion 310*b* can be removed (refer to P1 of FIG. 34).

Third Modification

Figure 35:
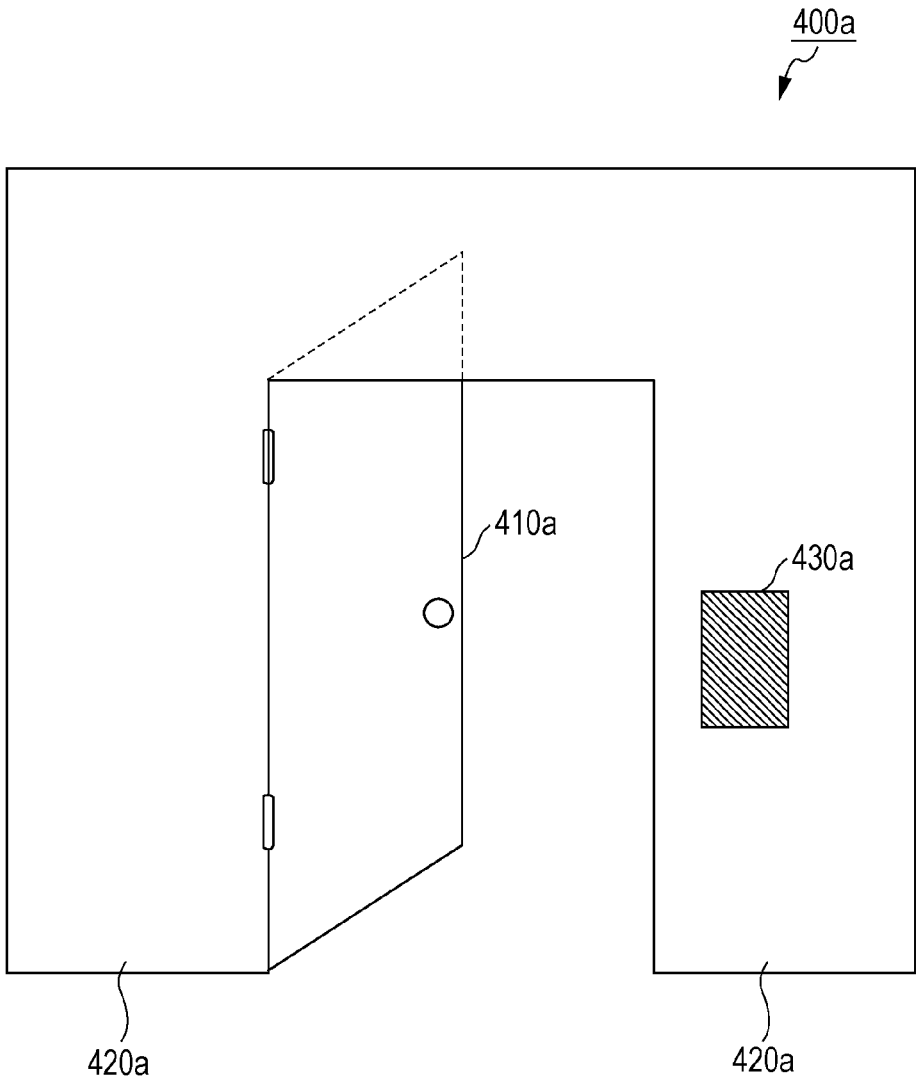
FIG. 35 is a diagram illustrating the appearance of a training machine according to a third modification.

In the embodiment, a fitness machine such as a stationary bicycle is taken as an example of the training machine 400, but the training machine 400 is not limited to the fitness machine. The training machine 400 may be a studio, like a training machine 400*a* illustrated in FIG. 35. In the training machine 400*a*, a key ID detection unit 430*a* is provided on a wall 420*a* near a door 410*a*. If the key ID detection unit 430*a* obtains the key ID from the key 300 or 300*b* during predetermined reception time of one of predetermined studio programs, the training machine 400*a* transmits the key ID to the server 500. The server 500 searches the key database 910 for a locker ID and the locker body database 920 for a user ID on the basis of the locker ID. The server 500 may store, in the training record database 820, information indicating that a user corresponding to the user ID has participated in a program corresponding to the reception time. For example, if the key 300 or 300*b* touches the key ID detection section 430*a* at 12:58, information indicating that the user indicated by the user ID associated with the key ID has participated in aerobics from 13:00 to 14:00 is stored in the training record database 820 of the server 500.

Fourth Modification

It is to be noted that the process performed by each component of the information management system 10 need not be performed by each component. Another component of the information management system 10 may perform the process, instead.

Although the method for managing information according to one or a plurality of aspects of the present disclosure has been described on the basis of the embodiment, the present disclosure is not limited to the embodiment. Modes constructed by modifying the embodiment in ways conceived by those skilled in the art and combining components in different embodiments may be included in the scope of the one or the plurality of aspects of the present disclosure insofar as the scope of the present disclosure is not deviated from.

The present disclosure is effective as a method for managing information or the like used by an information management system connected to lockers and training machines through a network.

What is claimed is:

1. A method for managing information used by an information management system connected, through a network, to a locker and a machine, the method comprising:

obtaining, through a first communication circuit included in the locker, a user identifier and a locker identifier from the locker into which the user card storing a user identifier indicating a user is inserted, the locker including i) a locking mechanism in which a key storing a key identifier becomes removable when the user card is inserted and ii) a first memory storing the locker identifier;

obtaining, through a second communication circuit included in the machine, the key identifier and a machine identifier from the machine that has read the key identifier, the training machine including i) a reader that reads the key identifier from the key and ii) a second memory storing the machine identifier; and outputting, using a first database that associates the locker identifier and the key identifier with each other and using the obtained locker identifier and the obtained user identifier, the user identifier corresponding to the key identifier to the machine to set the user identifier to the machine.

2. The method according to claim 1, wherein the machine includes a display, and the method further comprising:

outputting, using a second database that manages history information indicating how the user indicated by the user identifier has used the machine, the history information corresponding to the user identifier to the machine to display the history information on a display of the machine.

3. The method according to claim 1, wherein the machine further includes a memory storing a training program, a display that displays an image after the training program is activated, and a controller that controls the machine on the basis of the training program, the method further comprising:

setting the user identifier to the machine to enable the user corresponding to the user identifier to use the training program on the machine.

4. The method according to claim 1, wherein the machine identifier stored in the second memory of the machine is an Internet Protocol address, the method further comprising:

outputting the user identifier corresponding to the key identifier to the machine corresponding to the Internet Protocol address.

5. The method according to claim 1, wherein the locker identifier stored in the first memory of the locker is an Internet Protocol address corresponding to the locker, the method further comprising:

obtaining the Internet Protocol address corresponding to the locker as the locker identifier.

6. The method according to claim 1, wherein IDm used in near field communication is used as the key identifier.

7. The method according to claim 1, wherein IDm used in near field communication is used as the user identifier.

8. The method according to claim 1, further comprising:

obtaining, through the first communication circuit, the locker identifier and the user identifier from the locker into which the user card is inserted, when the user card is inserted into the locker.

9. The method according to claim 1, wherein the reader is a detector that reads the key identifier from the key if the key enters a certain range around the machine, the method further comprising:

obtaining, through the second communication circuit, the machine identifier and the key identifier from the machine that has read the key identifier, when the reader detects the key.

10. The method according to claim 1, wherein the key includes a key portion and a belt portion, and wherein the belt portion includes a holder that holds the key identifier and a communicator that transmits the key identifier.

* * * * *